US011649083B2

(12) United States Patent
Tong et al.

(10) Patent No.: US 11,649,083 B2
(45) Date of Patent: May 16, 2023

(54) BAG-MAKING AND PACKAGING APPARATUS

(71) Applicant: ISHIDA CO., LTD., Kyoto (JP)

(72) Inventors: Yuchuan Tong, Ritto (JP); Masayuki Yamane, Ritto (JP); Satoshi Hashimoto, Ritto (JP)

(73) Assignee: ISHIDA CO., LTD.

( * ) Notice: Subject to any disclaimer, the term of this patent is extended or adjusted under 35 U.S.C. 154(b) by 8 days.

(21) Appl. No.: 17/474,049

(22) Filed: Sep. 14, 2021

(65) Prior Publication Data

US 2022/0081144 A1 Mar. 17, 2022

(30) Foreign Application Priority Data

Sep. 16, 2020 (JP) ..... JP2020-155622

(51) Int. Cl.

| | |
|---|---|
| ***B65B 57/04*** | (2006.01) |
| ***B65B 41/16*** | (2006.01) |
| ***B31B 70/10*** | (2017.01) |
| ***B31B 70/16*** | (2017.01) |
| *B31B 155/00* | (2017.01) |

(52) U.S. Cl.

CPC ..... *B65B 57/04* (2013.01); *B31B 70/10* (2017.08); *B31B 70/16* (2017.08); *B65B 41/16* (2013.01); *B31B 2155/00* (2017.08)

(58) Field of Classification Search

CPC ..... B65B 57/04; B65B 41/16; B31B 70/10; B31B 70/16; B31B 2155/00

See application file for complete search history.

(56) References Cited

U.S. PATENT DOCUMENTS

| | | | | |
|---|---|---|---|---|
| 3,902,301 | A * | 9/1975 | Harkness | B29C 66/83543 53/553 |
| 11,046,468 | B2 * | 6/2021 | Shimoda | B65B 9/20 |
| 2017/0369265 | A1 * | 12/2017 | Murgia Mendizabal | B65B 41/12 |

FOREIGN PATENT DOCUMENTS

| | | |
|---|---|---|
| JP | 2008-127091 A | 6/2008 |
| JP | 2012-140248 A | 7/2012 |

OTHER PUBLICATIONS

The Office Action from the corresponding Australian Patent Application No. 2021232734 dated Sep. 29, 2022.

* cited by examiner

*Primary Examiner* — Thomas M Wittenschlaeger
(74) *Attorney, Agent, or Firm* — Shinjyu Global IP

(57) ABSTRACT

A bag-making and packaging apparatus includes a bag-making and packaging unit, a film feeding unit, a splicing device, and a control unit. The control unit allows a bag-making operation to continue by utilizing an auto-feeding function that feeds to the bag-making and packaging unit a film F spliced by the splicing device to take the place of a film F currently being fed to the bag-making and packaging unit. When the control unit judges that at least one of the film feeding unit and the splicing device is malfunctioning in a case where the control unit is utilizing the auto-feeding function, the control unit stops the auto-feeding function and executes a non-auto-feeding mode. The non-auto-feeding mode allows the bag-making operation to be continued by the bag-making and packaging unit and a film roll holding unit that is operable among plural film roll holding units.

6 Claims, 14 Drawing Sheets

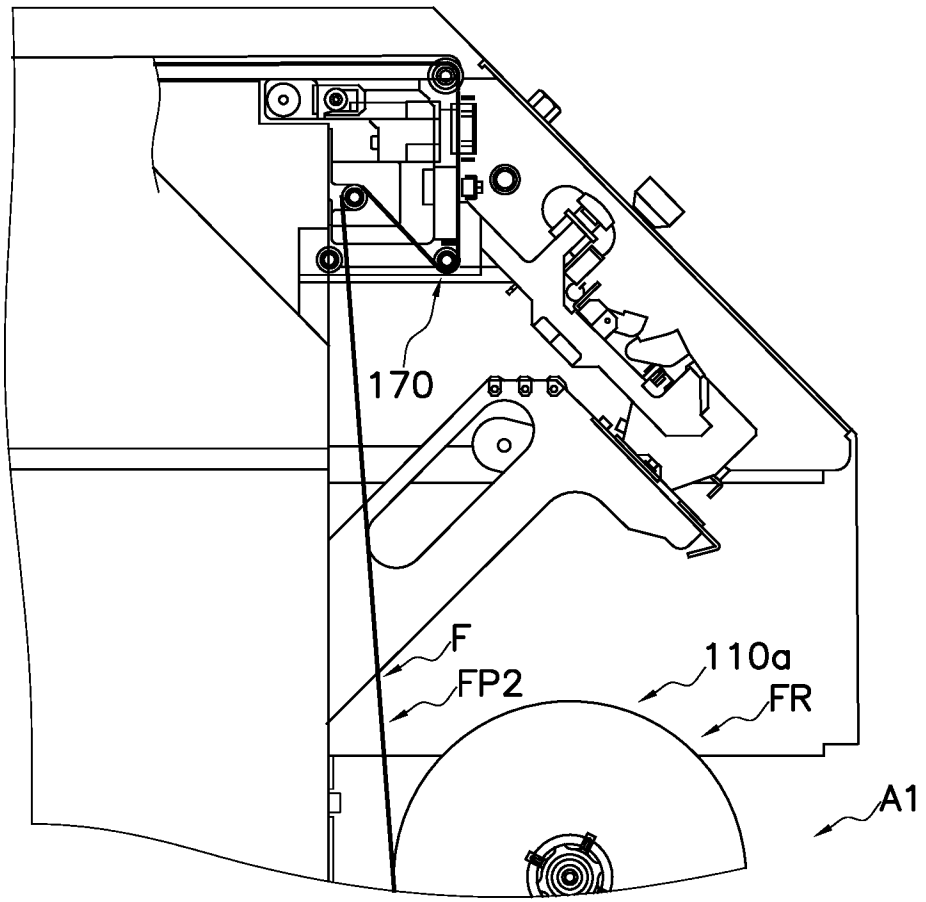
FIG. 14
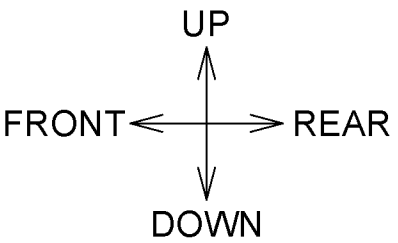

BAG-MAKING AND PACKAGING APPARATUS

CROSS-REFERENCE TO RELATED APPLICATIONS

This application claims priority to Japanese Patent Application No. 2020-155622, filed Sep. 16, 2020. The contents of that application are incorporated by reference herein in their entirety.

TECHNICAL FIELD

This invention relates to a bag-making and packaging apparatus.

BACKGROUND ART

Conventionally, as disclosed in (JP-A No. 2008-127091, a bag-making and packaging apparatus is known which uses a bag-making and packaging unit to form into bags a sheet-like film drawn from a film feeding unit and produces bags filled with contents.

BRIEF SUMMARY

In the bag-making and packaging apparatus disclosed in JP-A No. 2008-127091, in a case where a malfunction occurs in at least one of a film feeding unit and a splicing device, it is conceivable that the bag-making operation will stop until the malfunctioning part is replaced. For this reason, in the bag-making and packaging apparatus pertaining to JP-A No. 2008-127091, there is the concern that productivity will be reduced until the malfunctioning part is replaced.

It is an object of this invention to provide a bag-making and packaging apparatus that can inhibit a reduction in productivity even in a case where a malfunction occurs in at least one of a film feeding unit and a splicing device.

A bag-making and packaging apparatus pertaining to a first aspect includes a bag-making and packaging unit, a film feeding unit, a splicing device, and a control unit. The bag-making and packaging unit forms a sheet-like film into a tubular shape. The bag-making and packaging unit seals the film that has been formed into the tubular shape to thereby form the film into bags. The film feeding unit has plural film roll holding units that hold film rolls in which the sheet-like film is wound. The film feeding unit feeds to the bag-making and packaging unit the film that is drawn from one film roll. The splicing device automatically splices together the film being fed from the film feeding unit and the film that is wound in another film roll. The control unit allows a bag-making operation to continue by utilizing an auto-feeding function that feeds to the bag-making and packaging unit the film spliced by the splicing device to take the place of the film currently being fed to the bag-making and packaging unit. When the control unit judges that at least one of the film feeding unit and the splicing device is malfunctioning in a case where the control unit is utilizing the auto-feeding function, the control unit stops the auto-feeding function and executes a non-auto-feeding mode. The non-auto-feeding mode allows the bag-making operation to be continued by the bag-making and packaging unit and the film roll holding unit that is operable among the plural film roll holding units.

According to this configuration, when the control unit judges that at least one of the film feeding unit and the splicing device is malfunctioning, the control unit stops the auto-feeding function and executes the non-auto-feeding mode. The non-auto-feeding mode allows the bag-making operation to be continued by the bag-making and packaging unit and the film roll holding unit that is operable among the plural film roll holding units. For this reason, in the bag-making and packaging apparatus pertaining to the first aspect, a reduction in productivity is inhibited even in a case where a malfunction occurs in at least one of the film feeding unit and the splicing device.

A bag-making and packaging apparatus pertaining to a second aspect is the bag-making and packaging apparatus of the first aspect, further including an operating mode switching unit. The operating mode switching unit at least receives an operation for switching the operating mode from an operator.

A bag-making and packaging apparatus pertaining to a third aspect is the bag-making and packaging apparatus of the first aspect or the second aspect, wherein when the control unit judges that at least one of the film feeding unit and the splicing device is malfunctioning in a case where the control unit is utilizing the auto-feeding function, the control unit stops the auto-feeding function and stops the operation of the bag-making and packaging unit.

According to this configuration, when the control unit judges that at least one of the film feeding unit and the splicing device is malfunctioning, the operation of the bag-making and packaging unit stops. For this reason, in the bag-making and packaging apparatus pertaining to the third aspect, the safety of the operator in a case where a malfunction occurs in at least one of the film feeding unit and the splicing device is ensured.

A bag-making and packaging apparatus pertaining to a fourth aspect is the bag-making and packaging apparatus pertaining to the third aspect, wherein when the control unit stops the operation of the bag-making and packaging unit, the control unit switches to the non-auto-feeding mode in a case where an operating mode switching unit that at least receives an operation for switching the operating mode from the operator has received an operation to switch to the non-auto-feeding mode.

According to this configuration, the switch to the non-auto-feeding mode is performed after the operation of the bag-making and packaging unit has stopped. For this reason, in the bag-making and packaging apparatus pertaining to the fourth aspect, the safety of the operator when switching the bag-making and packaging apparatus to the non-auto-feeding mode is ensured.

A bag-making and packaging apparatus pertaining to a fifth aspect is the bag-making and packaging apparatus pertaining to the third aspect or the fourth aspect, wherein when the control unit stops the operation of the bag-making and packaging unit, the control unit resumes the operation of the bag-making and packaging unit in a case where the path of the film fed to the bag-making and packaging unit has been changed from a first path to a second path. The first path is a path when utilizing the splicing device. The second path is a path different from the first path.

According to this configuration, the operation of the bag-making and packaging unit resumes after the path of the film has been changed. For this reason, in the bag-making and packaging apparatus pertaining to the fifth aspect, the safety of the operator when changing the path of the film in the bag-making and packaging apparatus is ensured.

A bag-making and packaging apparatus pertaining to a sixth aspect is the bag-making and packaging apparatus pertaining to any of the first aspect to the fifth aspect, wherein the film feeding unit includes a motor that rotates the film roll, a motor that rotates a frame that supports the film roll holding units, and a sensor that detect the posture of the frame that supports the film roll holding units. The splicing device includes at least one of a heater for applying heat to and thermocompressively bonding the film, a cutting member for cutting the film, and a pinch roller for conveying the film.

According to this configuration, when the control unit judges that the motor that rotate the film roll, the motor that rotates the frame that supports the film roll holding units, the sensor that detect the posture of the film roll holding units, the heater for applying heat to and thermocompressively bonding the film, the cutting member for cutting the film, and the pinch roller for conveying the film is malfunctioning, the control unit stops the auto-feeding function and executes the non-auto-feeding mode. In the bag-making and packaging apparatus pertaining to the sixth aspect, a reduction in productivity is inhibited.

In the bag-making and packaging apparatus pertaining to the invention, a reduction in productivity is inhibited even in a case where a malfunction occurs in at least one of the film feeding unit and the splicing device.

Furthermore, in the bag-making and packaging apparatus pertaining to the invention, the safety of the operator is ensured even in a case where a malfunction occurs in at least one of the film feeding unit and the splicing device.

BRIEF DESCRIPTION OF DRAWINGS

FIG. 14 is a drawing showing a second path of the film.

DETAILED DESCRIPTION

An embodiment of the bag-making and packaging apparatus pertaining to the invention is described below with reference to the drawings as appropriate. It will be noted that the following embodiment is a specific example of the invention, is not intended to limit the technical scope of the invention, and may be changed as appropriate to the extent that it does not depart from the spirit of the invention.

Furthermore, in the following description, expressions such as "front (front side)," "rear (back side)," "upper," "lower," "left," and "right" are sometimes used to indicate directions and the like. Unless otherwise specified, "front (front side)," "rear (back side)," "upper," "lower," "left," and "right" here follow the directions of the arrows added to the drawings.

(1) OVERALL CONFIGURATION

Figure 1:
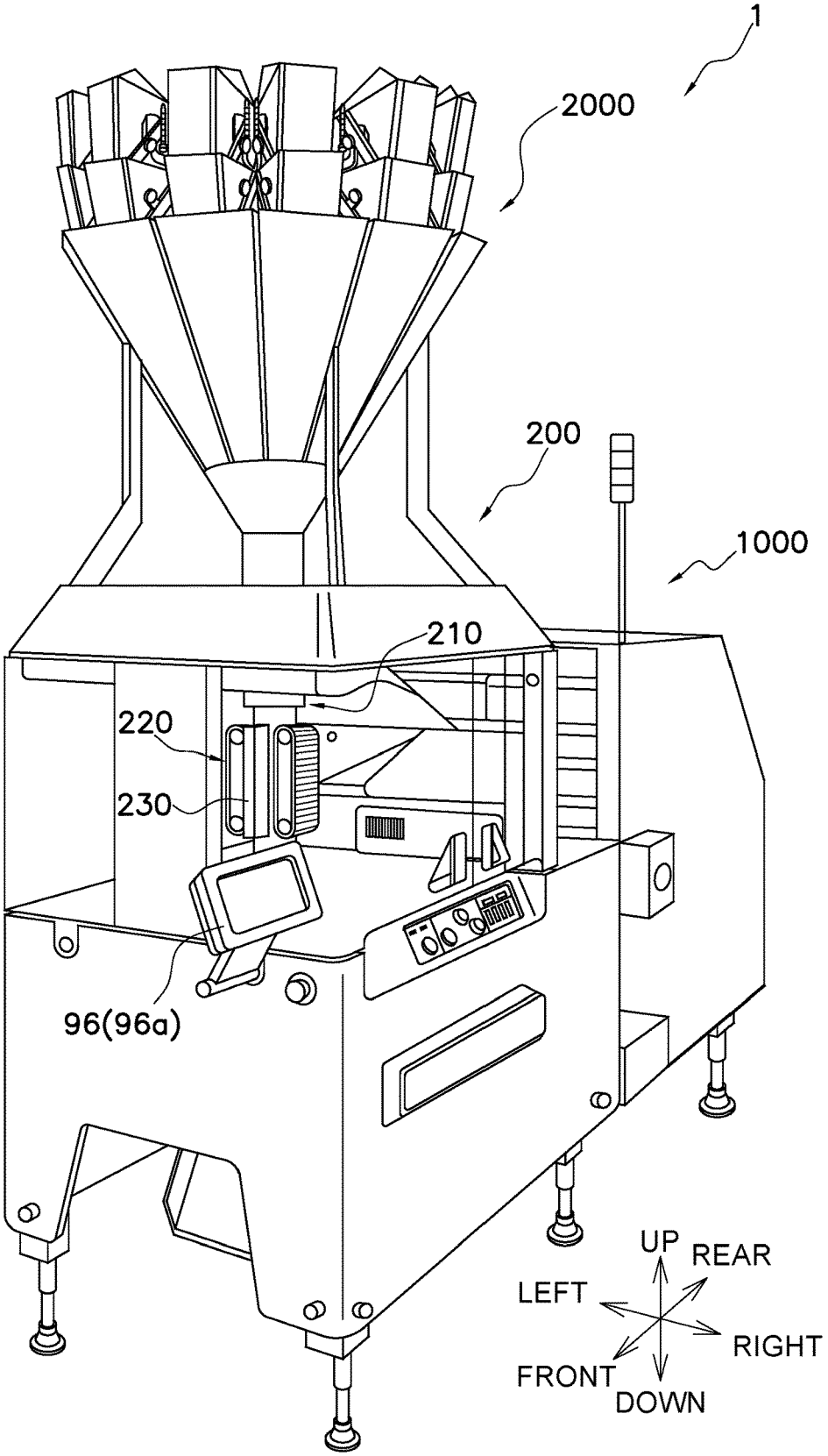
FIG. 1 is general perspective view of a combination weighing/bag-making and packaging system that includes a bag-making and packaging apparatus pertaining to an embodiment of the invention.
Figure 2:
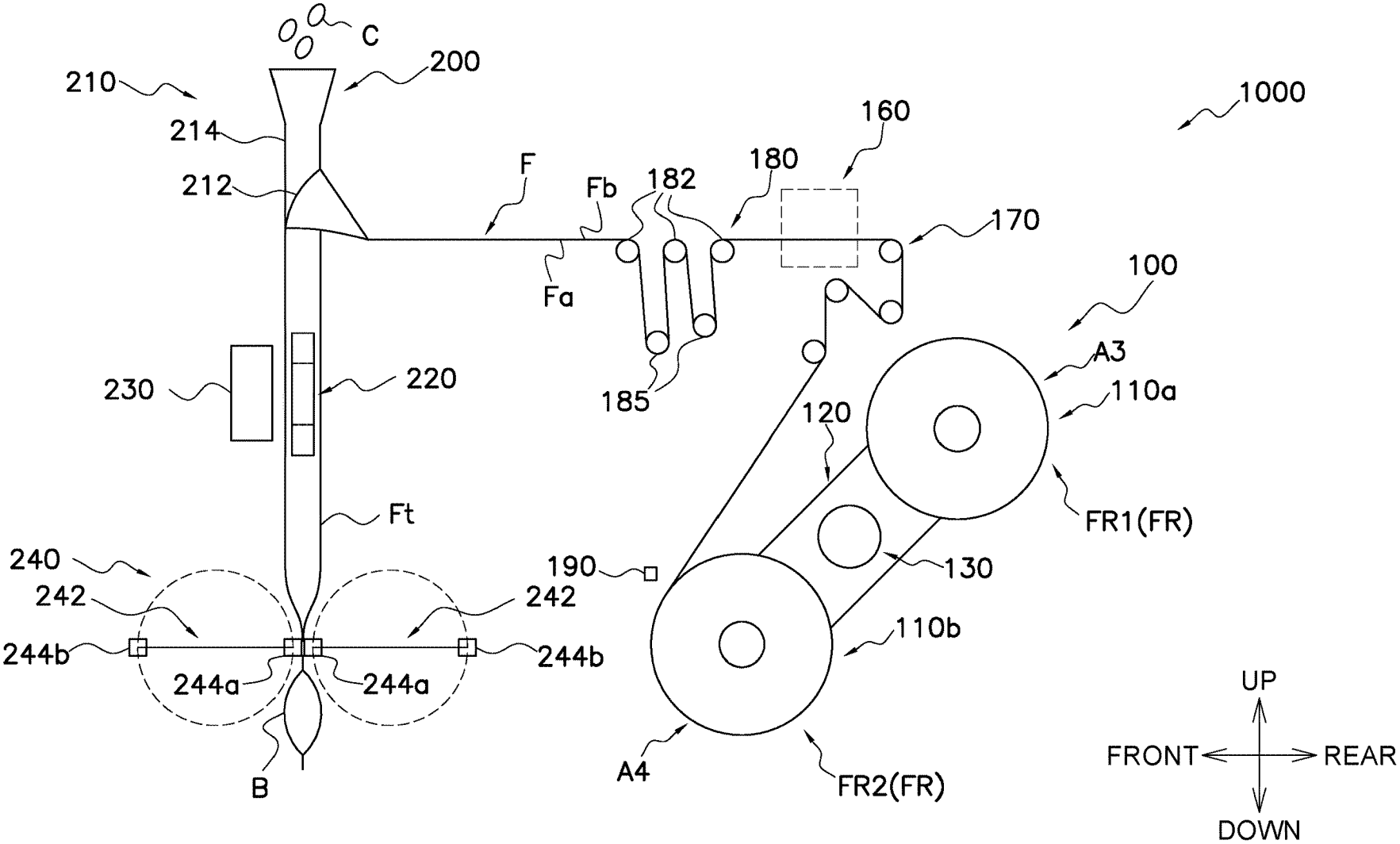
FIG. 2 is a general configuration diagram of the bag-making and packaging apparatus that the combination weighing/bag-making and packaging system of FIG. 1 has.
Figure 3:
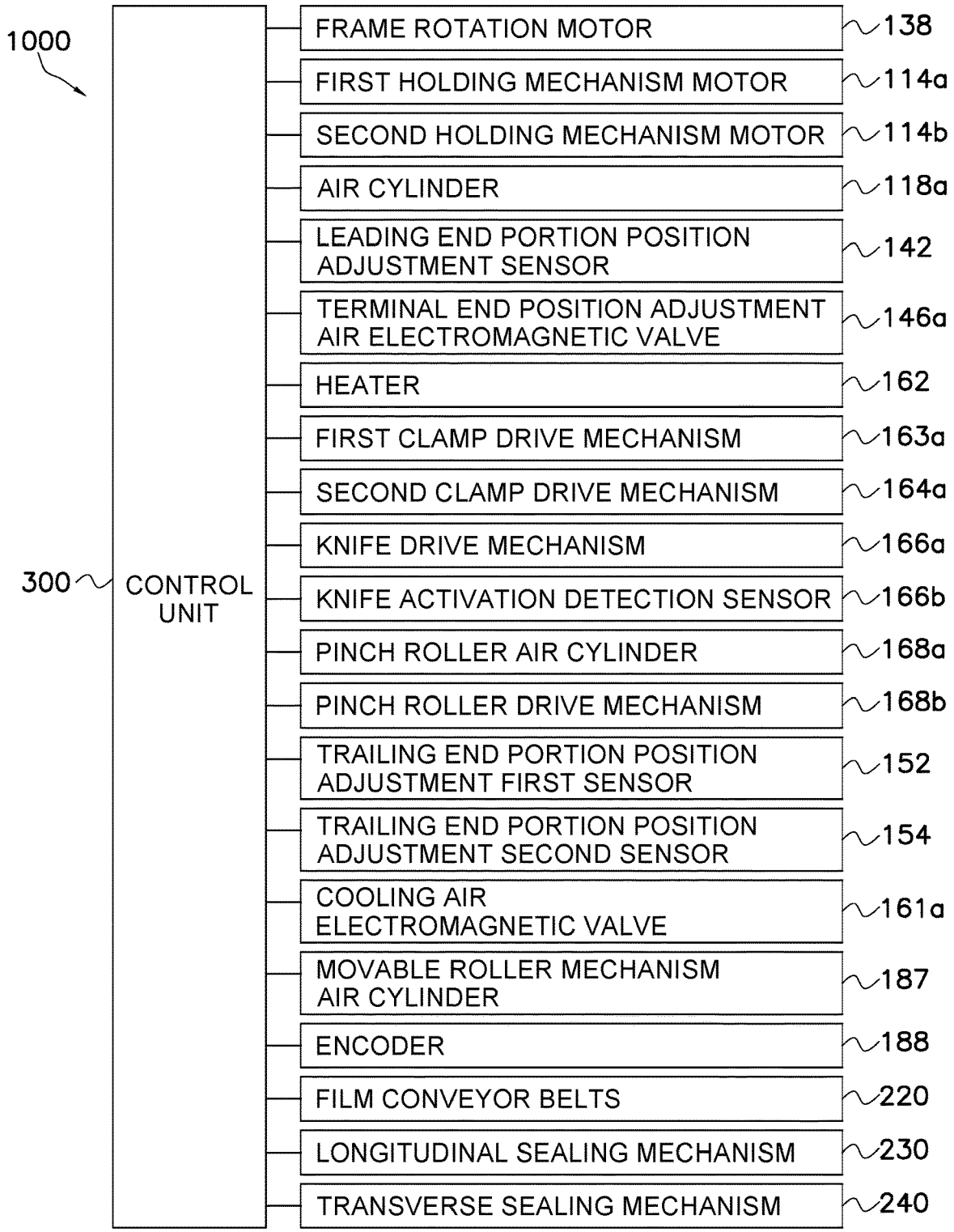
FIG. 3 is a block diagram of the bag-making and packaging apparatus of FIG. 2.
Figure 4:
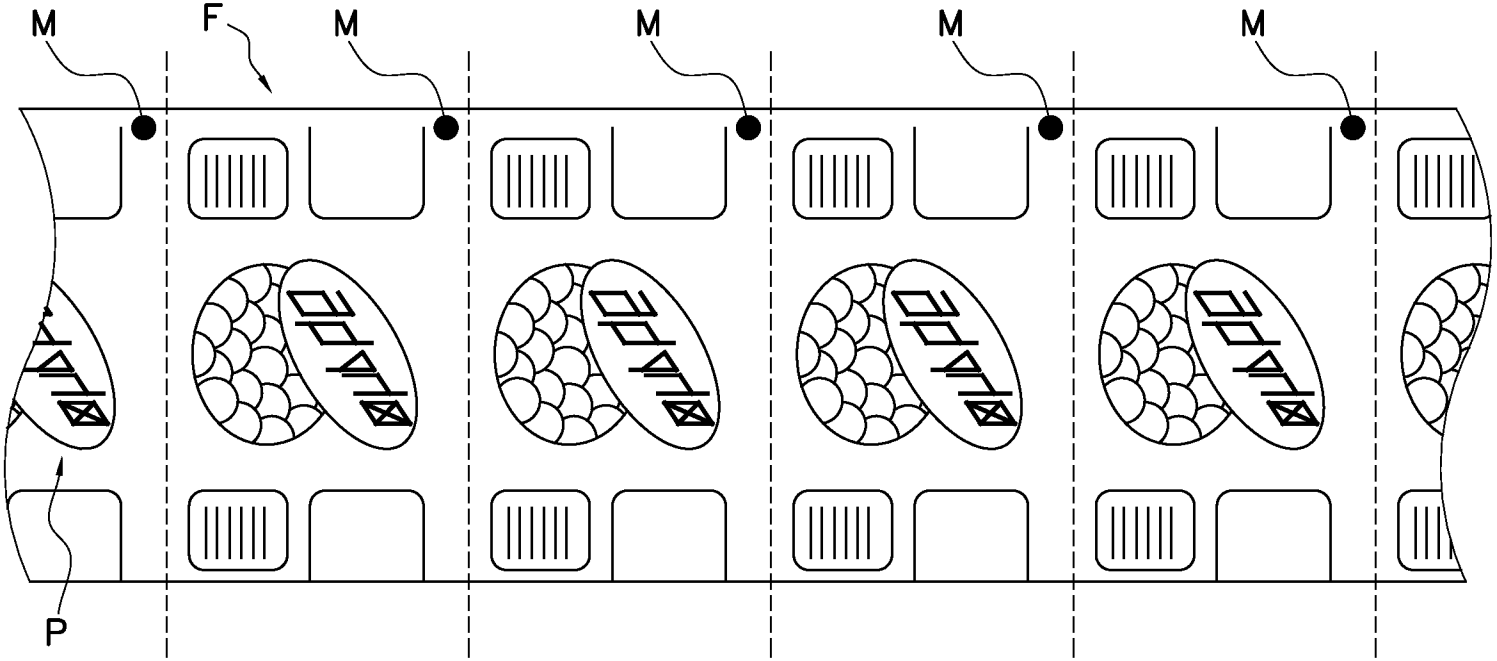
FIG. 4 is a drawing showing an example of a film used in the bag-making and packaging apparatus of FIG. 2.

FIG. 1 is a general perspective view of a combination weighing/bag-making and packaging system 1 that includes a bag-making and packaging apparatus 1000 pertaining to an embodiment of the invention. FIG. 2 is a general configuration diagram of the bag-making and packaging apparatus 1000. FIG. 3 is a block diagram of the bag-making and packaging apparatus 1000. FIG. 4 is a drawing showing an example of a film F used in the bag-making and packaging apparatus 1000.

The combination weighing/bag-making and packaging system 1 includes a combination weighing apparatus 2000 and the bag-making and packaging apparatus 1000 (see FIG. 1).

The bag-making and packaging apparatus 1000 is an apparatus that makes bags B containing articles C inside by manufacturing a bag-like packaging material from a sheet-like film F (see FIG. 2).

The film F used here includes a printed surface Fa (see FIG. 4), which is disposed on the outer surface side when the film F has been formed into the bags B, and a non-printed surface Fb, which is on the reverse side of the printed surface Fa. The printed surface Fa has printing P on it. The non-printed surface Fb does not have printing on it. The printing P is, for example, characters, illustrations, and photographs that are printed for the purpose of advertising and promoting the sale of the articles C as a product and providing information relating to the articles C. In addition to the printing P, registration marks M used to detect the position of the film F are also printed on the printed surface Fa. The articles C are fed from the combination weighing apparatus 2000 installed above the bag-making and packaging apparatus 1000 (see FIG. 2).

Furthermore, as shown in FIG. 1, the bag-making and packaging apparatus 1000 includes a liquid crystal display 96. The liquid crystal display 96 is attached to the front surface of the bag-making and packaging apparatus 1000 body. The liquid crystal display 96 is a touch panel display disposed in a position where an operator can see it. The liquid crystal display 96 functions as an input device that receives instructions for the bag-making and packaging apparatus 1000 and settings relating to the bag-making and packaging apparatus 1000. The liquid crystal display 96 functions as an operating mode switching unit **96*a*** that at least receives an operation for switching the operating mode from an operator.

The bag-making and packaging apparatus 1000 pertaining to this embodiment includes a control unit 300 that can allow a bag-making operation to continue by utilizing an auto-feeding function. The auto-feeding function is described later. The bag-making and packaging apparatus 1000 pertaining to this embodiment has, as operating modes, an auto-feeding mode that utilizes the auto-feeding function and a non-auto-feeding mode that does not utilize the auto-feeding function. The operating mode is switched, for example, by input using the liquid crystal display 96 functioning as the operating mode switching unit 96*a*.

Below, for convenience of description, the operation of the bag-making and packaging apparatus 1000 in the auto-feeding mode is described. Consequently, unless otherwise specified, the operations of each part of the bag-making and packaging apparatus 1000 described below are operations in the auto-feeding mode. For this reason, the operations of each part in the non-auto-feeding mode are not limited to the following description.

The bag-making and packaging apparatus 1000 includes a bag-making and packaging unit 200, a film feeding unit 100, a splicing device 160, and a control unit 300 (see FIG. 2 and FIG. 3). The control unit 300 controls the operations of the various constituent devices of the bag-making and packaging unit 200, the film feeding unit 100, and the splicing device 160. The film feeding unit 100 has plural film roll holding units that hold film rolls FR in which the sheet-like film F is wound and feeds to the bag-making and packaging unit 200 the film F that is drawn from one film roll FR. The bag-making and packaging unit 200 forms the sheet-like film F into a tubular shape and seals the film Ft that has been formed into the tubular shape to thereby form the film Ft into bags.

Figure 6:
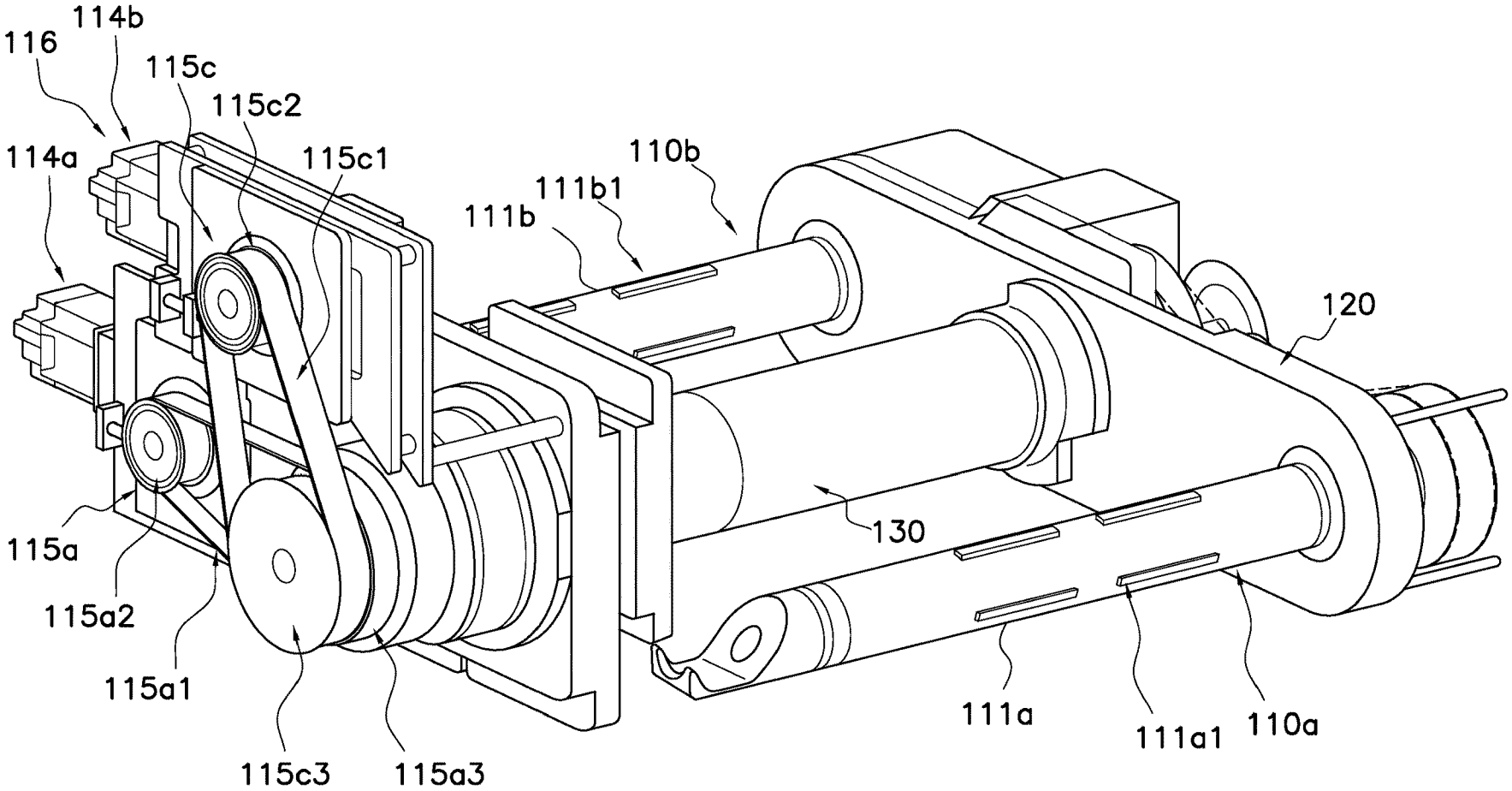
FIG. 6 is an enlarged perspective view around a holding mechanism support frame of the film feeding unit of FIG. 5.

The film feeding unit 100 mainly has, as mechanisms relating to the feeding of the film F, a first holding mechanism 110*a* and a second holding mechanism 110*b* (which correspond to the "film roll holding units" in the claims), a film drawing mechanism 116, and a tension adjusting mechanism 180 (see FIG. 2 and FIG. 6). The holding mechanisms 110*a*, 110*b* hold the film rolls FR in which the sheet-like film F is wound (see FIG. 2). Specifically, the first holding mechanism 110*a* has a shaft 111*a* on which a film roll FR is mounted and which rotatably holds the film roll FR mounted thereon (see FIG. 6). The second holding mechanism 110*b* has a shaft 111*b* on which a film roll FR is mounted and which rotatably holds the film roll FR mounted thereon (see FIG. 6).

It will be noted that the film rolls FR are rolls in which the sheet-like film F of FIG. 4 is wound around a winding core (not shown in the drawings). The terminal end on the winding core side of the film F wound in the film roll FR is connected (secured) to the winding core by, for example, affixing it with tape not shown in the drawings to the winding core or adhering it with an adhesive or the like to the winding core.

The film drawing mechanism 116 is a mechanism that rotates the shafts (the first shaft 111*a* and the second shaft 111*b*) of the plural holding mechanisms (the first holding mechanism 110*a* and the second holding mechanism 110*b*) to thereby draw, respectively independently, the films F from the film rolls FR mounted on the shafts of the holding mechanisms. The film drawing mechanism 116 has a first holding mechanism motor 114*a* and a second holding mechanism motor 114*b* (which correspond to the "motors that rotate the film rolls" in the claims). The first holding mechanism motor 114*a* is a mechanism that rotates the shaft 111*a* to thereby draw the film from the film roll FR mounted on the shaft 111*a*. The second holding mechanism motor 114*b* is a mechanism that rotates the shaft 111*b* to thereby draw the film from the film roll FR mounted on the shaft 111*b*.

In this way, in this bag-making and packaging apparatus 1000, the film F is not drawn using a single film drawing mechanism (e.g., a pinch roller disposed on the downstream side of the film rolls FR in the conveyance direction of the film F) but is drawn using the respectively independent holding mechanism motors 114*a*, 114*b* from the film rolls FR mounted on the shafts 111*a*, 111*b* of the plural holding mechanisms 110*a*, 110*b*.

Figure 9:
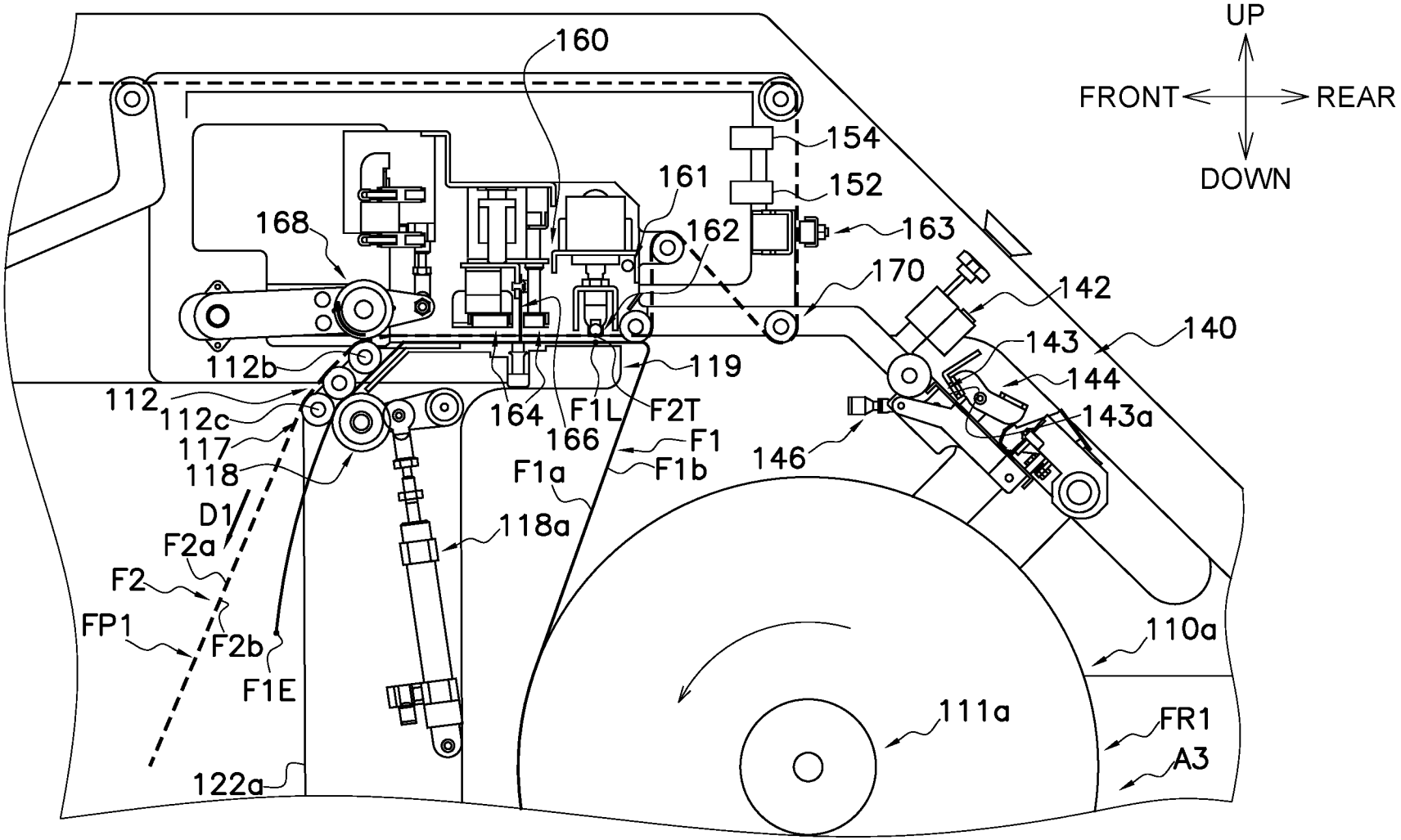
FIG. 9 is an enlarged side view of main portions of the film feeding unit of FIG. 5 in a state in which the first holding mechanism has been moved to a film roll standby position.

The splicing device 160 mainly has a heater 162, a first clamp 163, a second clamp 164, a knife 166, a pinch roller 168, a trailing end portion position adjustment first sensor 152, a trailing end portion position adjustment second sensor 154, and a cooling air electromagnetic valve 161*a* (see FIG. 9). The splicing device 160 is used mainly for detecting that the film F of the film roll FR (for convenience of description, hereinafter sometimes called the used film roll FR) that one of the holding mechanisms 110*a*, 110*b* holds has been used up, adjusting the position of the trailing end portion of the film F of the used film roll FR to an appropriate position, and splicing the trailing end portion of the film F of the used film roll FR to the film F of the film roll FR (for convenience of description, hereinafter sometimes called the replacement film roll FR) that the other of the holding mechanisms 110*a*, 110*b* holds.

The bag-making and packaging unit 200 mainly has a former unit 210, which has a former body 212 and a tube 214, film conveyor belts 220, a longitudinal sealing mechanism 230, and a transverse sealing mechanism 240 (see FIG. 2).

The bag-making and packaging apparatus 1000 performs a bag-making and packaging operation generally by the following flow as a result of the operations of the various constituent devices of the bag-making and packaging unit 200 and the film feeding unit 100 being controlled by the control unit 300.

The sheet-like film F is fed to the bag-making and packaging unit 200 from the film roll FR that one of the two holding mechanisms 110*a*, 110*b* of the film feeding unit 100 holds. In a case where the sheet-like film F is fed from the film roll FR mounted on the first shaft 111*a* of the first holding mechanism 110*a*, the film F is drawn by the first holding mechanism motor 114*a*. In a case where the sheet-like film F is fed from the film roll FR mounted on the second shaft 111*b* of the second holding mechanism 110*b*, the film F is drawn by the second holding mechanism motor 114*b*. The sheet-like film F that has been pulled out from the film roll FR is conveyed by the film conveyor belts 220 of the bag-making and packaging unit 200 to the bag-making and packaging unit 200. The sheet-like film F that is conveyed to the bag-making and packaging unit 200 is guided by plural rollers 170 including movable rollers 185 and fixed rollers 182 of the tension adjusting mechanism 180 described later and is conveyed to the former body 212 of the former unit 210. The tension adjusting mechanism 180 uses the movable rollers 185 to apply force to the film F and adjust the tension in the film F that is conveyed. The former body 212 forms the sheet-like film F into a tubular shape to thereby form the tubular film Ft. The tubular film Ft is conveyed downward by the film conveyor belts 220, and an overlapping portion of the tubular film Ft is sealed in the longitudinal direction by the longitudinal sealing mechanism 230 disposed under the former body 212. The tubular film Ft that has been sealed in the longitudinal direction (the film conveyance direction) by the longitudinal sealing mechanism 230 is conveyed further downward by the film conveyor belts 220 and is sealed in a direction intersecting (in particular, here, a direction orthogonal to) the conveyance direction of the tubular film Ft by the transverse sealing mechanism 240 disposed under the longitudinal sealing mechanism 230. Moreover, the transverse sealing mechanism 240 also cuts, in the transverse direction, the transversely sealed portion of the tubular film Ft at its middle portion in the conveyance direction of the tubular film Ft to thereby make the bags B whose upper and lower ends are sealed. It will be noted that before the tubular film Ft is sealed by the transverse sealing mechanism 240, the articles C are fed through the tube 214 of the former unit 210 to the inside of the tubular film Ft that becomes the bags B. As a result, in the bag-making and packaging apparatus 1000, the bags B containing the articles C are made. The bags B containing the articles C and made by the bag-making and packaging apparatus 1000 are conveyed to a downstream process by, for example, a conveyor (not shown in the drawings) disposed under the transverse sealing mechanism 240.

(2) DETAILED CONFIGURATION

The bag-making and packaging unit 200, the film feeding unit 100, the splicing device 160, and the control unit 300 of the bag-making and packaging apparatus 1000 will now be described in greater detail.

(2-1) Bag-Making and Packaging Unit

The former unit 210, the film conveyor belts 220, the longitudinal sealing mechanism 230, and the transverse sealing mechanism 240 of the bag-making and packaging unit 200 will now be described.

The former unit 210 mainly has the former body 212 and the tube 214 (see FIG. 2).

The former body 212 is disposed surrounding the open cylinder-shaped tube 214 in its circumferential direction. The former body 212 forms into a tubular shape the sheet-like film F pulled out from the film roll FR and conveyed to the former body 212 by folding the film F so that the left end portion and the right end portion of the film F overlap each other.

The tube 214 is an open cylinder-shaped member that extends in the vertical direction and whose upper and lower end portions are open. The tube 214 accepts, through the opening in its upper portion, the articles C that drop thereto (see FIG. 2). The articles C that have been input through the opening in the upper portion of the tube 214 pass through the inside of the tube 214 and are fed through the opening in the lower portion of the tube 214 to the inside of the tubular film Ft.

The bag-making and packaging unit 200 has a pair of the film conveyor belts 220 (see FIG. 2). The pair of film conveyor belts 220 convey to the former body 212 the film F that is pulled out from the film roll FR. Furthermore, the film conveyor belts 220 convey to the transverse sealing mechanism 240 the tubular film Ft that has been formed by the former body 212.

The longitudinal sealing mechanism 230 (see FIG. 2) is a mechanism that longitudinally seals (seals in the up and down direction) the overlapping portion of the tubular film Ft wrapped around the tube 214.

The longitudinal sealing mechanism 230 has a heater (not shown in the drawings), a heater belt (not shown in the drawings) that contacts the overlapping portion of the tubular film Ft, and a drive mechanism (not shown in the drawings) that drives the heater belt. The longitudinal sealing mechanism 230 heat-seals, in the longitudinal direction, the overlapping portion of the tubular film Ft by applying the heated heater belt to the overlapping portion of the tubular film Ft to thereby press, with a predetermined pressure, the overlapping portion of the tubular film Ft against the tube 214.

The transverse sealing mechanism 240 is a mechanism that transversely seals the tubular film Ft conveyed downward by the film conveyor belts 220 after the tubular film Ft has been longitudinally sealed by the longitudinal sealing mechanism 230.

The transverse sealing mechanism 240 has a pair of rotating bodies 242 that are disposed in front and in back of the tubular film Ft (see FIG. 2). Attached to each rotating body 242 are a sealing jaw 244*a* and a sealing jaw 244*b* that have built-in heaters (see FIG. 2). The pair of sealing jaws 244*a* pinch the tubular film Ft in a state in which they press against each other, apply pressure and heat to the part of the tubular film Ft that becomes the upper and lower end portions of the bags B, and transversely seal the tubular film Ft. A cutter not shown in the drawings is built into one of the sealing jaws 244*a*. The cutter cuts the transversely sealed portion of the tubular film Ft at its middle position in the conveyance direction of the tubular film Ft to thereby cut apart the bag B and the subsequent tubular film Ft.

The transverse sealing of the tubular film Ft and the cutting of the tubular film Ft by the sealing jaws 244*b* are the same as those performed by the sealing jaws 244*a*, so description thereof is omitted.

(2-2) Film Feeding Unit

The film feeding unit 100 will now be described with reference to more drawings.

Figure 5:
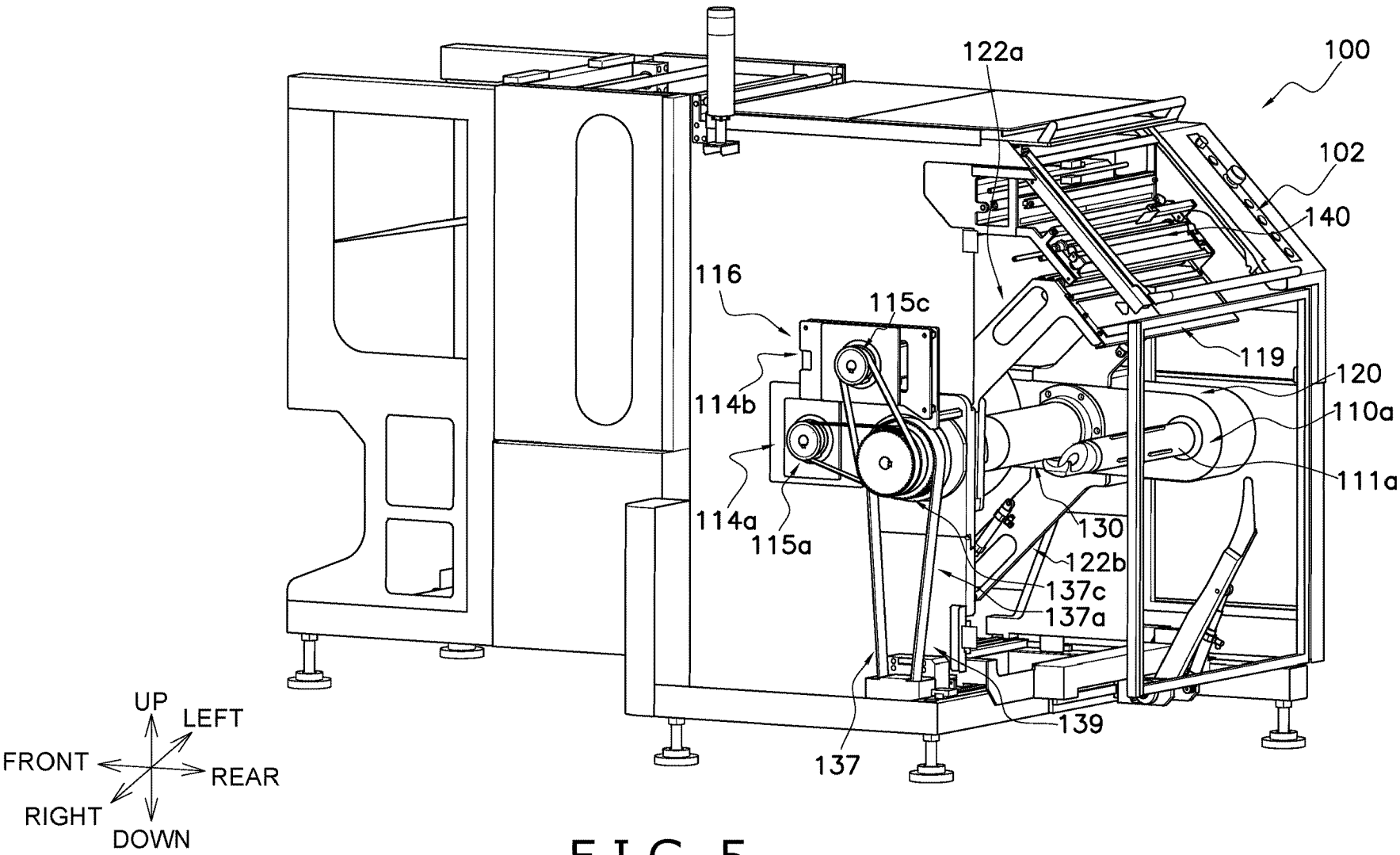
FIG. 5 is a general perspective view of a film feeding unit of the bag-making and packaging apparatus of FIG. 2.
Figure 7:
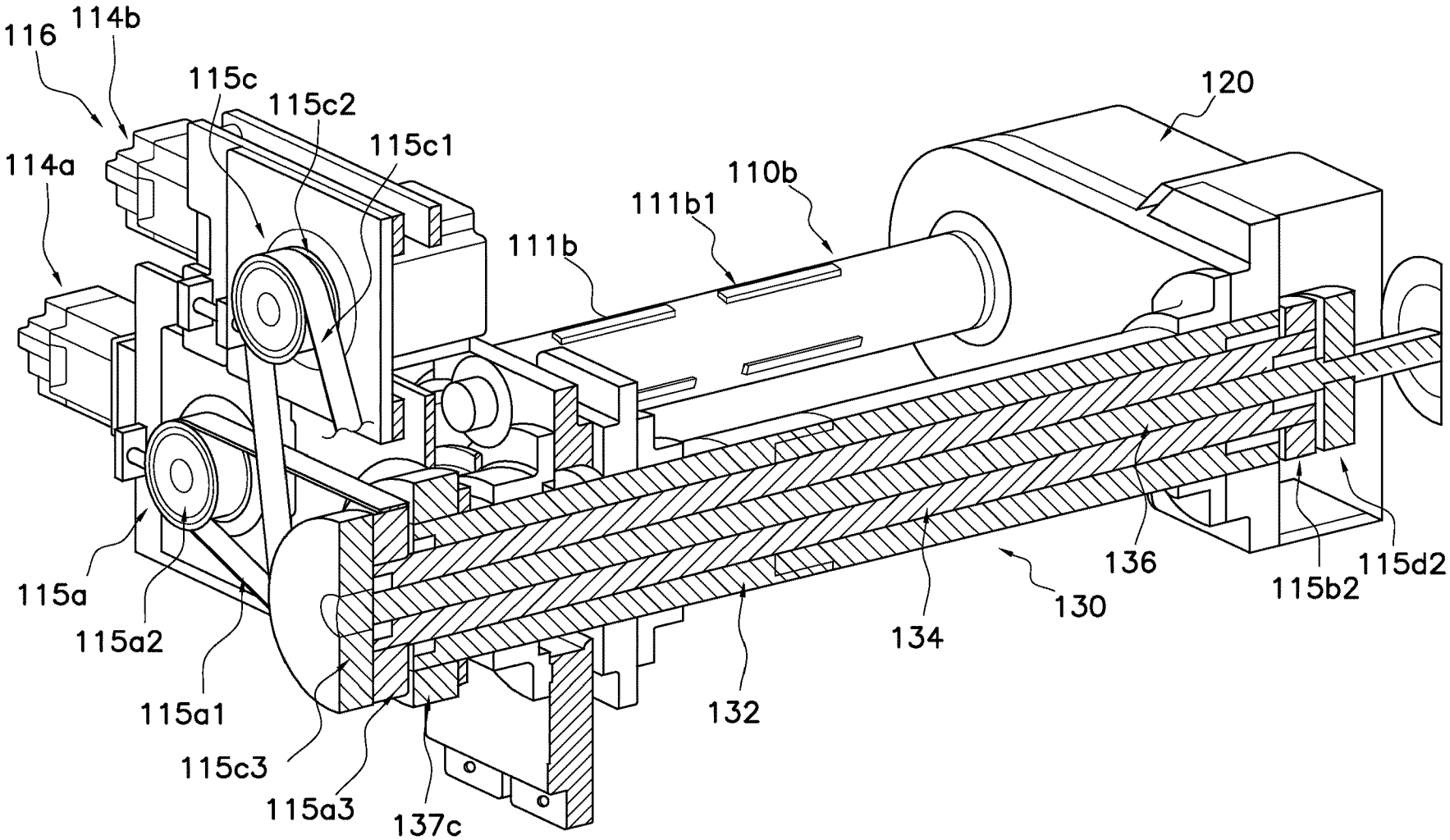
FIG. 7 is a sectional perspective view showing the internal structure of a frame shaft that rotatably supports the holding mechanism support frame of FIG. 6.
Figure 8:
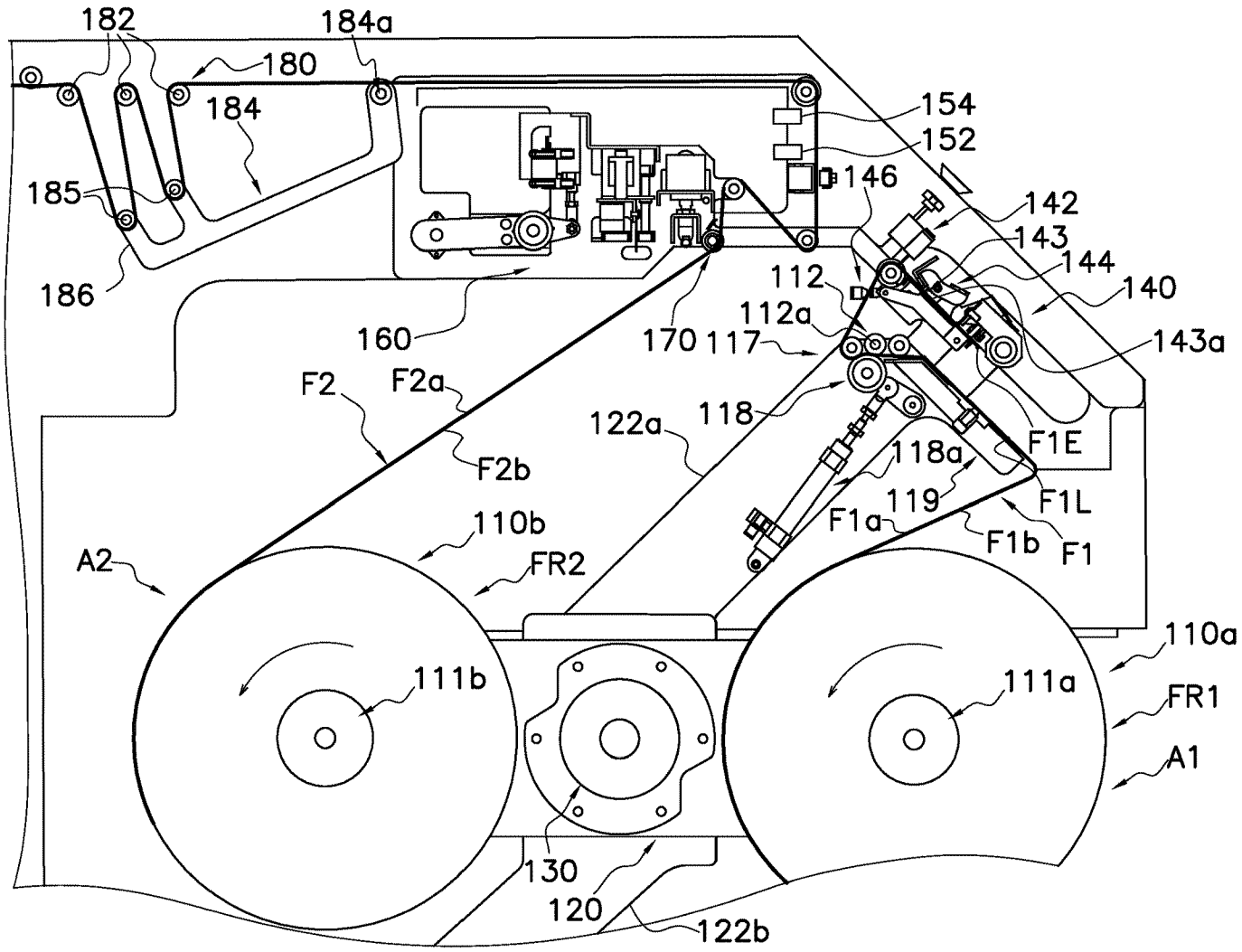
FIG. 8 is an enlarged side view of main portions of the film feeding unit of FIG. 5 in a state in which a first film roll has been attached to a first holding mechanism.
Figure 10:
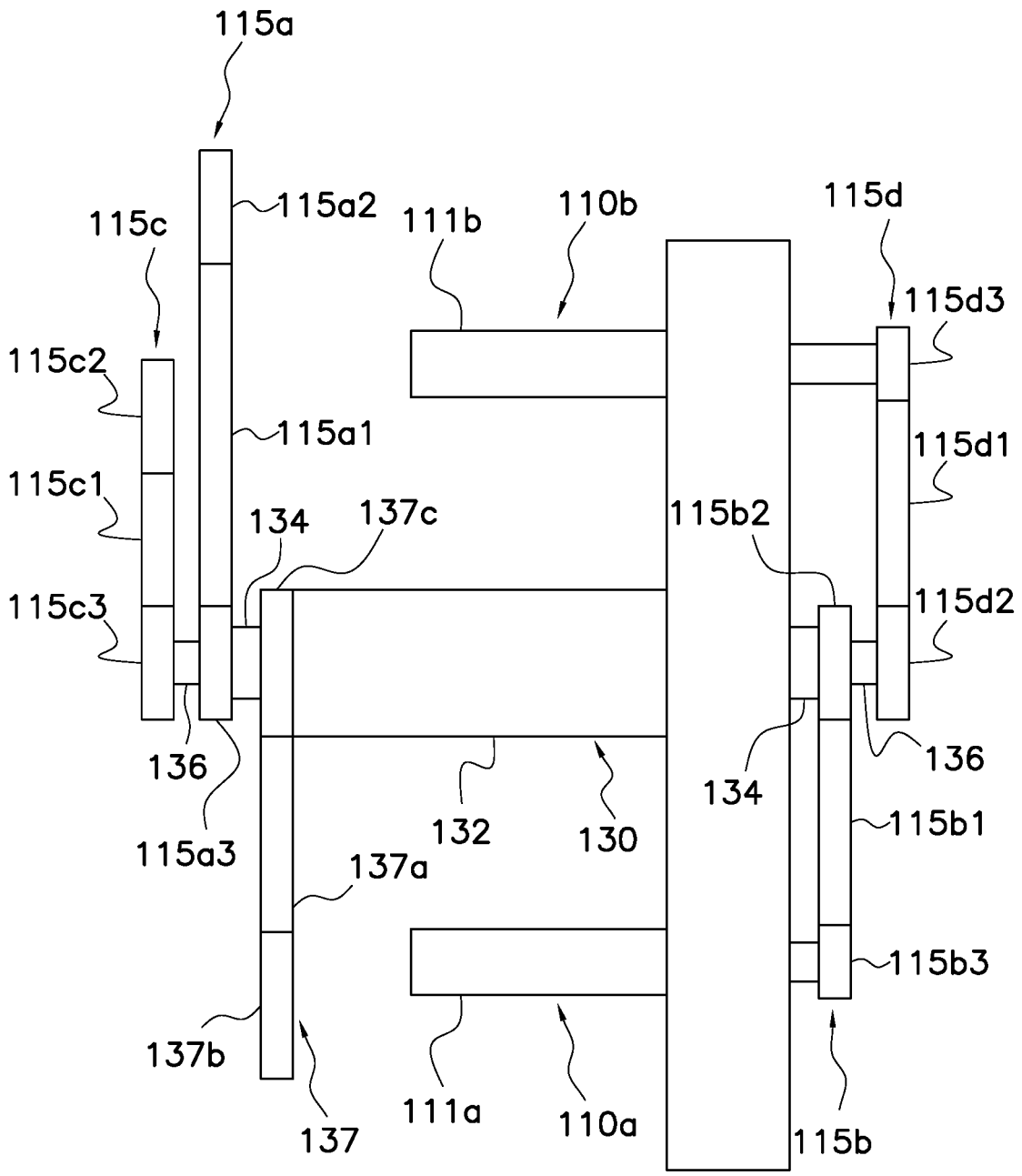
FIG. 10 is a general plan view, around the frame shaft of the film feeding unit of FIG. 5, for describing the transmission of driving force with respect to the frame shaft, a first shaft, and a second shaft.

FIG. 5 is a general perspective view of the film feeding unit 100. FIG. 6 is an enlarged perspective view around a holding mechanism support frame 120 of the film feeding unit 100. FIG. 7 is a sectional perspective view showing the internal structure of a frame shaft 130 that rotatably supports the holding mechanism support frame 120. FIG. 8 is an enlarged side view of main portions of the film feeding unit 100 in a state in which the film rolls FR have been attached to the first holding mechanism 110*a* and the second holding mechanism 110*b*. FIG. 9 is an enlarged side view of main portions of the film feeding unit 100 in a state in which the first holding mechanism 110*a* has been moved to a film roll standby position A3. FIG. 10 is a general plan view, around the frame shaft 130 of the film feeding unit 100, for describing the transmission of driving force with respect to the frame shaft 130, the first shaft 111*a*, and the second shaft 111*b*.

The film feeding unit 100 is a unit that feeds to the bag-making and packaging unit 200 the film F wound in the film rolls FR. In the film feeding unit 100, the film F is guided to the bag-making and packaging unit 200 by the plural rollers 170 that are disposed along a conveyance path of the film F. The rollers 170 include the fixed rollers 182 and the movable rollers 185 of the tension adjusting mechanism 180.

The film feeding unit 100 has the tension adjusting mechanism 180 that adjusts the tension that acts on the film F that is conveyed. Furthermore, the film feeding unit 100 has the first holding mechanism 110*a* and the second holding mechanism 110*b*, a holding mechanism support frame 120 (which corresponds to the "frame that supports the film roll holding units" in the claims), a frame shaft 130, a moving mechanism 139, and the film drawing mechanism 116. Furthermore, the film feeding unit 100 has a leading end portion position adjusting mechanism 140.

The leading end portion position adjusting mechanism 140 mainly includes a leading end portion position adjustment sensor 142, a film temporary placement member 143, a temporary restraining mechanism 144, and a terminal end position adjustment air nozzle 146. The leading end portion position adjusting mechanism 140 is used mainly for adjusting the position of the leading end portion of the film F wound in the film roll FR and the neighboring portion of the terminal end of the film F when a new film roll FR for replacement has been mounted on the first holding mechanism 110*a* or the second holding mechanism 110*b*.

It will be noted that, here, the leading end portion, the trailing end portion, and the terminal end of the film F are defined as follows.

First, in defining these terms, a case is supposed where the film F of the film roll FR (for convenience of description, hereinafter sometimes called the used film roll FR) that one of the first holding mechanism 110*a* and the second holding mechanism 110*b* holds is used up and the film F of the film roll FR (for convenience of description, hereinafter sometimes called the replacement film roll FR) that the other of the first holding mechanism 110*a* and the second holding mechanism 110*b* holds becomes spliced to the film F of the used film roll FR by a later-described heater 162.

The portion of the film F of the replacement film roll FR that becomes spliced to the film F of the used film roll FR at this time is called the leading end portion of the film F. Furthermore, the portion of the film F of the used film roll FR that becomes spliced to the leading end portion of the film F of the replacement film roll FR is called the trailing end portion of the film F. Furthermore, the terminal end of the film F here means the end on the pull-out side (the opposite side of the side connected to the winding core not shown in the drawings) of the film F wound in the replacement film roll FR. For example, using FIG. 8 and FIG. 9 as an example, the portion denoted by reference sign F1L is the leading end portion of the film F (of the replacement film roll FR), the portion denoted by reference sign F2T is the trailing end portion of the film F (of the used film roll FR), and the portion denoted by reference sign F1E is the terminal end of the film F (of the replacement film roll FR).

It will be noted that in the following description there are cases where, in addition to the above expressions, the expression "detects the trailing end of the film roll FR" is used. "Detects the trailing end of the film roll FR" means detecting a state in which all the film F wound in the film roll FR has been pulled out from the film roll FR.

Below, the devices, mechanisms, and members of the film feeding unit 100 are described.

It will be noted that the film rolls FR that the holding mechanisms 110*a*, 110*b* hold are the same type of film roll in which the same type of sheet-like film F is wound. However, below, for convenience of description, there are cases where the film roll that the first holding mechanism 110*a* holds is called a first film roll FR1 in which a sheet-like first film F1 is wound. Furthermore, there are cases where the film roll that the second holding mechanism 110*b* holds is called a second film roll FR2 in which a second film F2 is wound.

(2-2-1) Holding Mechanisms

The first holding mechanism 110*a* and the second holding mechanism 110*b* are mechanisms that hold the film rolls FR (the first film roll FR1 and the second film roll FR2) in which the sheet-like films F (the first film F1 and the second film F2) are wound around hollow winding cores (not shown in the drawings) (see FIG. 6).

The first holding mechanism 110*a* has the first shaft 111*a* on which the first film roll FR1 is mounted and which rotatably holds the first film roll FR1 mounted thereon (see FIG. 6). The first shaft 111*a* is a cantilever shaft having one end supported on the holding mechanism support frame 120 side. When a connection mechanism 111*a*1 (e.g., an air chuck) is driven in a state in which the first shaft 111*a* has been inserted through the hollow winding core of the first film roll FR1, the first film roll FR1 becomes secured to the first shaft 111*a* (see FIG. 6). When the first shaft 111*a* is rotated by the first holding mechanism motor 114*a* in this state, the first film roll FR1 rotates together with the first shaft 111*a*.

It is preferred that the first holding mechanism 110*a* has a first guide member 119 that guides the first film F1 so that the first film F1 is disposed along a predetermined path when performing positional adjustment of the leading end portion F1L of the first film F1 wound in the first film roll FR1 after the first film roll FR1 has been mounted on the first shaft 111*a* (see FIG. 8). Furthermore, it is preferred that the first holding mechanism 110*a* has a first film restraining mechanism 117 that restrains the first film F1 until the leading end portion F1L of the first film F1 and the trailing end portion F2T of the second film F2 become spliced together when the first film roll FR1 has been attached to the first shaft 111*a* and the leading end portion F1L of the first film F1 wound in the first film roll FR1 has been aligned with a prescribed position (the position where the leading end portion F1L should be disposed) in a way described later (see FIG. 8). The first film restraining mechanism 117 includes fixed rollers 112 and an air cylinder 118*a* that has a movable roller 118 attached to the distal end of a rod (see FIG. 8). When the air cylinder 118*a* is driven and the movable roller 118 is pushed against the fixed rollers 112, the first film F1 disposed between the movable roller 118 and the fixed rollers 112 becomes restrained between the movable roller 118 and the fixed rollers 112 (in particular, a fixed roller 112*a* disposed in the middle among three rollers disposed side by side in the state shown in FIG. 8). The first guide member 119, the fixed rollers 112, and the air cylinder 118*a* are attached to an arm 122*a* that extends from the holding mechanism support frame 120 (see FIG. 8).

The second holding mechanism 110*b* has the second shaft 111*b* on which the second film roll FR2 is mounted and which rotatably holds the second film roll FR2 mounted thereon (see FIG. 6). The second shaft 111*b* is a cantilever shaft having one end supported on the holding mechanism support frame 120 side. When a connection mechanism 111*b*1 (e.g., an air chuck) is driven in a state in which the second shaft 111*b* has been inserted through the hollow winding core of the second film roll FR2, the second film roll FR2 becomes secured to the second shaft 111*b* (see FIG. 6). When the second shaft 111*b* is rotated by the second holding mechanism motor 114*b* in this state, the second film roll FR2 rotates together with the second shaft 111*b*.

Furthermore, although detailed description is omitted for the sake of simplifying description, it is preferred that the second holding mechanism 110*b* also has a second guide member and a second film restraining mechanism (not shown in the drawings) having the same structures and functions as the first guide member 119 and the first film restraining mechanism 117.

(2-2-2) Tension Adjusting Mechanism

The tension adjusting mechanism 180 is a mechanism that adjusts the magnitude of the tension that acts on the film F that is conveyed. The tension adjusting mechanism 180 mainly has the three fixed rollers 182, a movable roller mechanism 184, a shaft 184*a*, a movable roller mechanism air cylinder 187, and an encoder 188 (see FIG. 3 and FIG. 8). The movable roller mechanism 184 has the two movable rollers 185 and a pair of arms 186 (see FIG. 8). The arms 186 are members that support the two movable rollers 185. The pair of arms 186 are disposed on the left side and the right side of the movable rollers 185, so as to sandwich the movable rollers 185 that extend in the right and left direction, and support the end portions of the movable rollers 185. The arms 186 are rotatably supported by the shaft 184*a* that extends in the right and left direction. The movable roller mechanism air cylinder 187 has a rod (not shown in the drawings) whose distal end is connected to an arm (not shown in the drawings) that extends in the radial direction from the shaft 184*a*. When the movable roller mechanism air cylinder 187 is driven, a force that causes the shaft 184*a* to rotate is generated.

The fixed rollers 182 and the movable rollers 185 are disposed on the conveyance path of the film F that is drawn from the film roll FR. The fixed rollers 182 and the movable rollers 185 are disposed between the film roll FR and the former body 212 in the conveyance direction of the film F (see FIG. 2). The fixed rollers 182 and the movable rollers 185 are all freely rotatable rollers. The fixed rollers 182 and the movable rollers 185 all extend in the right and left direction. The fixed rollers 182 are secured to a frame (not shown in the drawings) of the bag-making and packaging apparatus 1000, and their position does not change. In contrast, the movable rollers 185 are secured to the arms 186 that are rotatable about the axial center of the shaft 184*a* as described above, so their position is changed (i.e., movable) by the movement of the arms 186.

The fixed rollers 182 and the movable rollers 185 contact the film F conveyed thereto from the film roll FR and guide the film F. The film F is entrained about the fixed rollers 182 and the movable rollers 185 so that when the film F is conveyed from the film roll FR the film F sequentially contacts, from the upstream side, a fixed roller 182, a movable roller 185, a fixed roller 182, a movable roller 185, and a fixed roller 182 (see FIG. 8). The film F is entrained about the fixed rollers 182 and the movable rollers 185 in such a way that the fixed rollers 182 contact the lower surface (the printed surface Fa) of the film F that is conveyed and the movable rollers 185 contact the upper surface (the non-printed surface Fb) of the film F that is conveyed (see FIG. 8).

The movable rollers 185 that contact the upper surface of the film F conveyed thereto push the film F downward because of the resultant force of the self-weight of the movable roller mechanism 184 and the force that the movable roller mechanism air cylinder 187 produces to cause the shaft 184*a* to rotate. As a result, the movable rollers 185 cause tension to act on the film F. It will be noted that by controlling the operation of the movable roller mechanism air cylinder 187, the force with which the movable rollers 185 push the film F downward changes and the tension that acts on the film F changes.

It will be noted that the encoder 188 (see FIG. 3) for detecting the angle of rotation of the shaft 184*a* is attached to one end of the shaft 184*a*. The detection result of the encoder 188 is used in control of the position of the movable rollers 185 by the control unit 300 described later. Furthermore, the detection result of the encoder 188 can also be utilized in detection of the trailing end of the film roll FR by the control unit 300 described later.

(2-2-3) Holding Mechanism Support Frame

In this embodiment, the holding mechanism support frame 120 supports the first holding mechanism 110*a* and the second holding mechanism 110*b*. In particular, the holding mechanism support frame 120 rotatably supports the first shaft 111*a* of the first holding mechanism 110*a* and rotatably supports the second shaft 111*b* of the second holding mechanism 110*b*.

Furthermore, from the holding mechanism support frame 120 extend the arm 122*a* and an arm 122*b*. Attached to the arm 122*a* are the first guide member 119 and the fixed rollers 112 and the air cylinder 118*a* of the first film restraining mechanism 117 that the first holding mechanism 110*a* has. Attached to the arm 122*b* are the second guide member and the fixed rollers and the air cylinder of the second film restraining mechanism (not shown in the drawings). The second guide member and the second film restraining mechanism of the second holding mechanism 110*b* have the same structures and functions as the first guide member 119 and the first film restraining mechanism 117 of the first holding mechanism 110*a* except that they are for the second holding mechanism 110*b*.

(2-2-4) Frame Shaft

The frame shaft 130 is a shaft that rotatably supports the holding mechanism support frame 120.

When the holding mechanism support frame 120 rotates about the central axis of the frame shaft 130, the first shaft 111*a* of the first holding mechanism 110*a* and the second shaft 111*b* of the second holding mechanism 110*b* also rotate about the central axis of the frame shaft 130. Furthermore, when the holding mechanism support frame 120 rotates about the central axis of the frame shaft 130, the arm 122*a* and the arm 122*b* of the holding mechanism support frame 120 also rotate about the central axis of the frame shaft 130.

The frame shaft 130 has a multilayer shaft structure. Here, the frame shaft 130 has a three-layer shaft structure. The frame shaft 130 includes a first layer shaft 132 that is disposed as the outermost layer and is the largest in diameter, a third layer shaft 136 that is disposed as the innermost layer and is the smallest in diameter, and a second layer shaft 134 that is disposed between the first layer shaft 132 and the third layer shaft 136 (see FIG. 7). The first layer shaft 132, the second layer shaft 134, and the third layer shaft 136 can rotate respectively independently.

The first layer shaft 132 is a shaft for rotating the holding mechanism support frame 120. One end of the first layer shaft 132 is secured to the holding mechanism support frame 120. When the first layer shaft 132 is rotated by the moving mechanism 139 as described later, the holding mechanism support frame 120 rotates.

The second layer shaft 134 is a shaft for rotating the first shaft 111*a* of the first holding mechanism 110*a*. When the second layer shaft 134 is rotated by the film drawing mechanism 116 as described later, the first shaft 111*a* of the first holding mechanism 110*a* rotates. Specifically, when the second layer shaft 134 is rotated by the first holding mechanism motor 114*a* of the film drawing mechanism 116, the first shaft 111*a* of the first holding mechanism 110*a* is rotated and the first film F1 is drawn from the first film roll FR1 mounted on the first shaft 111*a*.

The third layer shaft 136 is a shaft for rotating the second shaft 111*b* of the second holding mechanism 110*b*. When the third layer shaft 136 is rotated by the film drawing mechanism 116 as described later, the second shaft 111*b* of the second holding mechanism 110*b* rotates. Specifically, when the third layer shaft 136 is rotated by the second holding mechanism motor 114*b* of the film drawing mechanism 116, the second shaft 111*b* of the second holding mechanism 110*b* is rotated and the second film F2 is drawn from the second film roll FR2 mounted on the second shaft 111*b*.

(2-2-5) Moving Mechanism

The moving mechanism 139 rotates the holding mechanism support frame 120 to thereby move the first holding mechanism 110*a* and the second holding mechanism 110*b* between at least a film roll setting position A1 and a film feeding position A2. Preferably, the moving mechanism 139 also rotates the holding mechanism support frame 120 to thereby move one of the first holding mechanism 110*a* and the second holding mechanism 110*b* to a film roll standby position A3 and move the other of the first holding mechanism 110*a* and the second holding mechanism 110*b* to a film feeding position A4. It will be noted that the film roll setting position A1 of the first holding mechanism 110*a* and the second holding mechanism 110*b* is the position where the first holding mechanism 110*a* is disposed in FIG. 8. The film feeding position A2 of the first holding mechanism 110*a* and the second holding mechanism 110*b* is the position where the second holding mechanism 110*b* is disposed in FIG. 8. The film roll standby position A3 of the first holding mechanism 110*a* and the second holding mechanism 110*b* is the position where the first holding mechanism 110*a* is disposed in FIG. 2 and FIG. 9. The film feeding position A4 of the first holding mechanism 110*a* and the second holding mechanism 110*b* is the position where the second holding mechanism 110*b* is disposed in FIG. 2. The film roll standby position A3 is a position rotated a predetermined angle (e.g., 45°) counter-clockwise from the film roll setting position A1 about the central axis of the frame shaft 130 as seen in a right side view. Furthermore, although this is not intended to be limiting, the film feeding position A2 is a position rotated a predetermined angle (e.g., 135°) counter-clockwise from the film roll standby position A3 about the central axis of the frame shaft 130 as seen in a right side view. Furthermore, the film feeding position A4 is a position rotated a predetermined angle (e.g., 45°) counter-clockwise from the film feeding position A2 about the central axis of the frame shaft 130 as seen in a right side view.

The film roll setting position A1 is a position where the film roll FR becomes mounted on the first shaft 111*a* of the first holding mechanism 110*a* and the second shaft 111*b* of the second holding mechanism 110*b*. That is, in this bag-making and packaging apparatus 1000, the film roll FR is mounted on the shafts 111*a*, 111*b* in the same position both with respect to the first holding mechanism 110*a* and with respect to the second holding mechanism 110*b*.

The film feeding positions A2, A4 are positions where the film F fed to the bag-making and packaging unit 200 is drawn from the film roll FR mounted on the shafts 111*a*, 111*b* at the time of the bag-making and packaging operation of the bag-making and packaging apparatus 1000. That is, one of the holding mechanisms 110*a*, 110*b* holding the film roll FR that feeds the film F to the bag-making and packaging unit 200 is disposed mainly in one of the film feeding position A2 and the film feeding position A4 when the bag-making and packaging operation is performed by the bag-making and packaging unit 200.

The film roll standby position A3 is a position where the first holding mechanism 110*a* on whose first shaft 111*a* the first film roll FR1 was mounted in the film roll setting position A1 stands by until the second film F2 of the second film roll FR2 that the second holding mechanism 110*b* is holding is used up. Furthermore, the film roll standby position A3 is a position where the second holding mechanism 110*b* on whose second shaft 111*b* the second film roll FR2 was mounted in the film roll setting position A1 stands by until the first film F1 of the first film roll FR1 that the first holding mechanism 110*a* is holding is used up.

When the first holding mechanism 110*a* has been moved to the film roll standby position A3, the leading end portion F1L of the first film F1 is moved to a position (called a splicing position) where it becomes spliced by the heater 162 to the trailing end portion F2T of the second film F2. Likewise, when the second holding mechanism 110*b* has been moved to the film roll standby position A3, the leading end portion of the second film F2 is moved to the position (the splicing position) where it becomes spliced by the heater 162 to the trailing end portion of the first film F1.

The structure of the moving mechanism 139 will now be described.

The moving mechanism 139 mainly includes a frame rotation motor 138 (which corresponds to the "motor that rotates a frame that supports the film roll holding units" in the claims) and a frame rotation transmission mechanism 137. The frame rotation motor 138 is a motor for rotating the holding mechanism support frame 120. The frame rotation transmission mechanism 137 is a mechanism that transmits the driving force of the frame rotation motor 138 to the first layer shaft 132 of the frame shaft 130.

The frame rotation transmission mechanism 137 includes a belt 137*a*, a drive roller 137*b*, and a follower roller 137*c*. The belt 137*a* is entrained about the drive roller 137*b* and the follower roller 137*c*. The drive roller 137*b* is connected to the frame rotation motor 138 and is driven by the frame rotation motor 138. The follower roller 137*c* is connected to one end of the first layer shaft 132 of the frame shaft 130 (the end portion of the first layer shaft 132 on the side not connected to the holding mechanism support frame 120). When the frame rotation motor 138 is driven, the drive roller 137*b* rotates, the follower roller 137*c* rotates via the belt 137*a*, and the first layer shaft 132 also rotates. Additionally, as a result of the first layer shaft 132 rotating, the holding mechanism support frame 120 is rotated and the first holding mechanism 110*a* and the second holding mechanism 110*b* are moved.

It will be noted that detection of the posture of the holding mechanism support frame 120 that has been rotated by the moving mechanism 139 can be realized inexpensively by, for example, a mechanism 400 such as described below.

Figure 11:
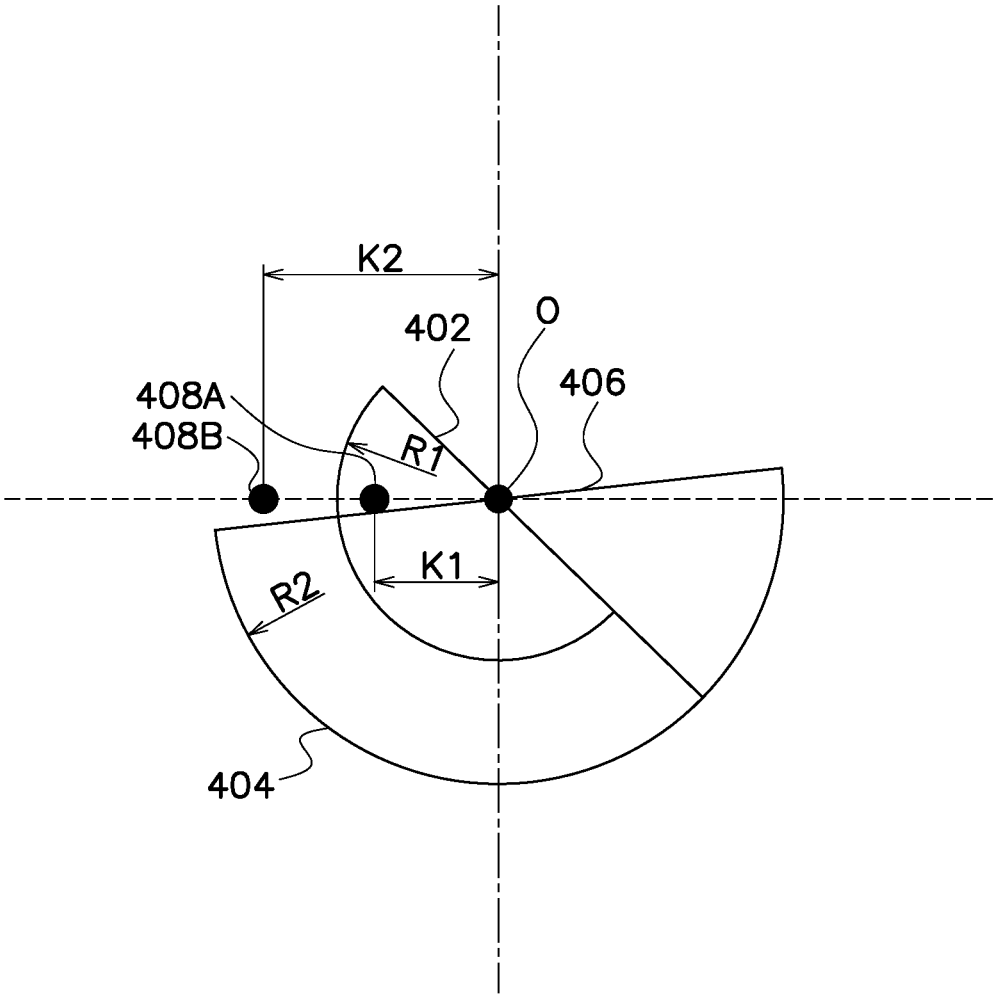
FIG. 11 is a drawing for describing a posture detection mechanism for detecting the posture of the holding mechanism support frame of FIG. 6.

As shown in FIG. 11, the mechanism 400 for detecting the posture of the holding mechanism support frame 120 has a first member 402, a second member 404, and a third member 406, which are secured to an end portion of the first layer shaft 132 (which rotate together with the first layer shaft 132), and two photoelectric sensors 408A, 408B (which correspond to the "sensors that detect the posture of the frame that supports the film roll holding units" in the claims). The first member 402 is a plate formed in the shape of a fan with a radius R1 centered on a rotational axis O of the first layer shaft 132 when the end portion of the first layer shaft 132 to which the first member 402 is attached is seen from the side. The second member 404 is a plate having a shape such as in FIG. 11 in which its outer peripheral side is defined by a circular arc with a radius R2 (>R1) centered on the rotational axis O of the first layer shaft 132, its inner peripheral side is defined by a circular arc with a radius R1 centered on the rotational axis O of the first layer shaft 132, and these circular arcs are interconnected by two straight lines extending in the radial direction with respect to the rotational axis O when the end portion of the first layer shaft 132 to which the second member 404 is attached is seen from the side. The third member 406 is a plate formed in the shape of a fan with a radius R2 centered on the rotational axis O of the first layer shaft 132 when the end portion of the first layer shaft 132 to which the third member 406 is attached is seen from the side. The photoelectric sensor 408A detects whether or not the first member 402 and the third member 406 are present in a position located a distance K1 (K1<R1) from the rotational center O when the end portion of the first layer shaft 132 to which the first member 402 is attached is seen from the side. The photoelectric sensor 408B is disposed on a straight line joining the rotational center O and the photoelectric sensor 408A and detects whether or not the second member 404 and the third member 406 are present in a position located a distance K2 (R1<K2<R2) away from the rotational center O when the end portion of the first layer shaft 132 to which the first member 402 is attached is seen from the side. The positions of the two photoelectric sensors 408A, 408B are constant regardless of the rotation of the first layer shaft 132.

The first member 402, the second member 404, and the third member 406 are disposed in such a way that when detection of the members 402, 404, 406 has been performed using the two photoelectric sensors 408A, 408B as in FIG. 11, depending on the angle of rotation of the first layer shaft 132 there arises a state in which just one of the two photoelectric sensors 408A, 408B is detecting a member, a state in which both of the two photoelectric sensors 408A, 408B are detecting a member, or a state in which neither of the two photoelectric sensors 408A, 408B is detecting a member. Additionally, by utilizing combinations of the detection results of the two photoelectric sensors 408A, 408B, the rough angle of rotation of the first layer shaft 132, and therefore the posture of the holding mechanism support frame 120, can be detected.

(2-2-6) Film Drawing Mechanism

The film drawing mechanism 116 rotates the shafts (the first shaft 111*a* and the second shaft 111*b*) of the plural holding mechanisms (the first holding mechanism 110*a* and the second holding mechanism 110*b*) to thereby draw, respectively independently, the film (the first film F1 and the second film F2) from the film rolls (the first film roll FR1 and the second film roll FR2) mounted on the shafts of the plural holding mechanisms. The film drawing mechanism 116 is configured to be capable of changing the drawing speed of the first film roll FR1 and the second film roll FR2 at the time of the bag-making and packaging operation in the bag-making and packaging unit 200.

The film drawing mechanism 116 includes the first holding mechanism motor 114*a*, the second holding mechanism motor 114*b*, a first transmission mechanism 115*a*, a second transmission mechanism 115*b*, a third transmission mechanism 115*c*, and a fourth transmission mechanism 115*d*.

The first holding mechanism motor 114*a* rotates the first shaft 111*a* of the first holding mechanism 110*a* among the plural holding mechanisms 110*a*, 110*b*. The first holding mechanism motor 114*a* preferably is a servo motor. The first transmission mechanism 115*a* transmits the driving force of the first holding mechanism motor 114*a* to the second layer shaft 134 of the frame shaft 130. The second transmission mechanism 115*b* transmits the driving force that has been transmitted to the second layer shaft 134 of the frame shaft 130 to the first shaft 111*a* of the first holding mechanism 110*a* that is the driving target of the first holding mechanism motor 114*a*.

The first transmission mechanism 115*a* includes a belt 115*a*1, a drive roller 115*a*2, and a follower roller 115*a*3. The belt 115*a*1 is entrained about the drive roller 115*a*2 and the follower roller 115*a*3. The drive roller 115*a*2 is connected to the first holding mechanism motor 114*a* and is driven by the first holding mechanism motor 114*a*. The follower roller 115*a*3 is connected to one end of the second layer shaft 134 of the frame shaft 130. When the first holding mechanism motor 114*a* is driven, the drive roller 115*a*2 rotates, the follower roller 115*a*3 rotates via the belt 115*a*1, and the second layer shaft 134 also rotates.

The second transmission mechanism 115*b* includes a belt 115*b*1, a drive roller 115*b*2, and a follower roller 115*b*3. The belt 115*b*1 is entrained about the drive roller 115*b*2 and the follower roller 115*b*3. The drive roller 115*b*2 is connected to one end (the end portion on the opposite side of the side where the follower roller 115*a*3 is connected) of the second layer shaft 134 of the frame shaft 130, and when the second layer shaft 134 rotates, the drive roller 115*b*2 also rotates. The follower roller 115*b*3 is connected to one end (the end portion on the side supported by the holding mechanism support frame 120) of the first shaft 111*a* of the first holding mechanism 110*a*. When the second layer shaft 134 rotates, the drive roller 115*b*2 rotates, the follower roller 115*b*3 rotates via the belt 115*b*1, and the first shaft 111*a* of the first holding mechanism 110*a* also rotates.

As described above, when the first holding mechanism motor 114*a* is driven, the driving force of the first holding mechanism motor 114*a* is transmitted via the first transmission mechanism 115*a* and the second transmission mechanism 115*b* to the first shaft 111*a* of the first holding mechanism 110*a*, whereby the first shaft 111*a* is rotated. As a result, the first film F1 is drawn from the first film roll FR1 mounted on the first shaft 111*a* of the first holding mechanism 110*a*.

The second holding mechanism motor 114*b* rotates the second shaft 111*b* of the second holding mechanism 110*b* among the plural holding mechanisms 110*a*, 110*b*. The second holding mechanism motor 114*b* preferably is a servo motor. The third transmission mechanism 115*c* transmits the driving force of the second holding mechanism motor 114*b* to the third layer shaft 136 of the frame shaft 130. The fourth transmission mechanism 115*d* transmits the driving force that has been transmitted to the third layer shaft 136 of the frame shaft 130 to the second shaft 111*b* of the second holding mechanism 110*b* that is the driving target of the second holding mechanism motor 114*b*.

The third transmission mechanism 115*c* includes a belt 115*c*1, a drive roller 115*c*2, and a follower roller 115*c*3. The belt 115*c*1 is entrained about the drive roller 115*c*2 and the follower roller 115*c*3. The drive roller 115*c*2 is connected to the second holding mechanism motor 114*b* and is driven by the second holding mechanism motor 114*b*. The follower roller 115*c*3 is connected to one end of the third layer shaft 136 of the frame shaft 130. When the second holding mechanism motor 114*b* is driven, the drive roller 115*c*2 rotates, the follower roller 115*c*3 rotates via the belt 115*c*1, and the third layer shaft 136 also rotates.

The fourth transmission mechanism 115*d* includes a belt 115*d*1, a drive roller 115*d*2, and a follower roller 115*d*3. The belt 115*d*1 is entrained about the drive roller 115*d*2 and the follower roller 115*d*3. The drive roller 115*d*2 is connected to one end (the end portion on the opposite side of the side where the follower roller 115*c*3 is connected) of the third layer shaft 136 of the frame shaft 130, and when the third layer shaft 136 rotates, the drive roller 115*d*2 also rotates. The follower roller 115*d*3 is connected to one end (the end portion on the side supported by the holding mechanism support frame 120) of the second shaft 111*b* of the second holding mechanism 110*b*. When the third layer shaft 136 rotates, the drive roller 115*d*2 rotates, the follower roller 115*d*3 rotates via the belt 115*d*1, and the second shaft 111*b* of the second holding mechanism 110*b* also rotates.

As described above, when the second holding mechanism motor 114*b* is driven, the driving force of the second holding mechanism motor 114*b* is transmitted via the third transmission mechanism 115*c* and the fourth transmission mechanism 115*d* to the second shaft 111*b* of the second holding mechanism 110*b*, whereby the second shaft 111*b* is rotated. As a result, the second film F2 is drawn from the second film roll FR2 mounted on the second shaft 111*b* of the second holding mechanism 110*b*.

(2-2-7) Leading End Portion Position Adjusting Mechanism

The leading end portion position adjusting mechanism 140 is a mechanism used mainly for adjusting the position of the leading end portion of the film F wound in the film roll FR and the neighboring portion of the terminal end of the film F when the replacement film roll FR has been mounted on the first holding mechanism 110*a* or the second holding mechanism 110*b*. The leading end portion position adjusting mechanism 140 includes the leading end portion position adjustment sensor 142, the film temporary placement member 143, the temporary restraining mechanism 144, and the terminal end position adjustment air nozzle 146 (see FIG. 8).

(2-2-7-1) Leading End Portion Position Adjustment Sensor

The leading end portion position adjustment sensor 142 is a sensor that detects that the leading end portion of the film F is positioned in the prescribed position when a film roll FR is mounted on the first shaft 111*a* and the second shaft 111*b* of the first holding mechanism 110*a* and the second holding mechanism 110*b* disposed in the film roll setting position A1 and the operator sets the leading end portion of the film F wound in that film roll FR in the prescribed position. It will be noted that the prescribed position of the leading end portion of the film F means a position where the leading end portion of the film F is disposed in the splicing position where the film F becomes spliced by the heater 162 when the holding mechanisms 110*a*, 110*b* in which the film roll FR positioned in the film roll setting position A1 was set have been moved by the moving mechanism 139 to the film roll standby position A3.

The leading end portion position adjustment sensor 142 is disposed higher than the film temporary placement member 143.

The leading end portion position adjustment sensor 142 is, for example, a registration mark sensor that detects the registration marks M printed on the printed surface Fa of the film F. Here, the leading end portion position adjustment sensor 142 detects that a registration mark M is positioned in a target position (the detection position of the leading end portion position adjustment sensor 142) and thereby detects, based on the detection result, that the leading end portion of the film F is positioned in the prescribed position.

(2-2-7-2) Film Temporary Placement Member

The film temporary placement member 143 is a member on which the neighborhood of the leading end portion of the film F pulled out from the film roll FR is manually temporarily placed when the operator of the bag-making and packaging apparatus 1000 attaches the replacement film roll FR to the holding mechanisms 110*a*, 110*b*, namely, mounts the replacement film roll FR on the shafts 111*a*, 111*b* of the holding mechanisms 110*a*, 110*b*. The film temporary placement member 143 has a temporary placement surface 143*a* on which the film F is temporarily placed.

The operation of setting the film F that the operator of the bag-making and packaging apparatus 1000 performs when attaching the replacement film roll FR (the first film roll FR1) to the holding mechanisms 110*a*, 110*b* may be performed using known methods. Consequently, here, description is omitted.

(2-2-7-3) Temporary Restraining Mechanism

The temporary restraining mechanism 144 is disposed in the neighborhood of the film temporary placement member 143. The temporary restraining mechanism 144 is a mechanism that temporarily restrains the film F to inhibit misalignment of the film F when the film F has been temporarily placed on the film temporary placement member 143. The temporary restraining mechanism 144 temporarily restrains the film F with just enough force to allow conveyance of the film F when the film F is conveyed by the holding mechanism motors 114*a*, 114*b* as described later.

(2-2-7-4) Terminal End Position Adjustment Air Nozzle

The terminal end position adjustment air nozzle 146 blows air onto the neighborhood of the terminal end on the leading end portion side of the film F to perform positional adjustment of the neighborhood of the terminal end of the film F when the holding mechanisms 110*a*, 110*b* are moved by the moving mechanism 139 from the film roll setting position A1 to the film roll standby position A3, or in other words when the leading end portion of the film F is moved to the splicing position where it becomes spliced by the heater 162. The blowing-out of the air from the terminal end position adjustment air nozzle 146 is controlled by a terminal end position adjustment air electromagnetic valve 146*a* (see FIG. 3).

The positional adjustment of the neighborhood of the terminal end of the film F by the terminal end position adjustment air nozzle 146 will now be described taking as an example positional adjustment of the neighborhood of the terminal end of the first film F1, for example.

When the moving mechanism 139 rotates the holding mechanism support frame 120 the predetermined angle counter-clockwise to move the first holding mechanism 110*a* from the film roll setting position A1 to the film roll standby position A3, the terminal end position adjustment air nozzle 146 blows air forwardly onto the printed surface F1*a* (the surface on the rear side) in the neighborhood of the terminal end FIE on the leading end portion F1L side of the first film F1. As a result, the first film F1 is positionally adjusted to a state in which it hangs down from the first film restraining mechanism 117 without wrapping around the fixed rollers 112 or the second film F2 that is being utilized for bag-making (see FIG. 9).

(2-3) Splicing Device

The splicing device 160 includes the heater 162, the first clamp 163, the second clamp 164, the knife 166 (which corresponds to the "cutting member for cutting the film" in the claims), the pinch roller 168 (which corresponds to the "pinch roller for conveying the film" in the claims), the trailing end portion position adjustment first sensor 152, the trailing end portion position adjustment second sensor 154, and the cooling air electromagnetic valve 161*a* (see FIG. 3 and FIG. 9).

(2-3-1) Heater

The heater 162 is a mechanism that splices together the trailing end portion of the film F wound in the film roll FR mounted on one of the shafts 111*a*, 111*b* of the holding mechanisms 110*a*, 110*b* and the leading end portion of the film F wound in the film roll FR mounted on the other of the shafts 111*b*, 111*a* of the holding mechanisms 110*b*, 110*a* (see FIG. 3 and FIG. 9). The heater 162 is a mechanism that applies heat to and thermocompressively bonds the films F.

Referring to FIG. 9, for example, the heater 162 applies heat to and thermocompressively bonds the trailing end portion F2T of the second film F2 wound in the second film roll FR2 mounted on the second shaft 111*b* of the second holding mechanism 110*b* and the leading end portion F1L of the first film F1 wound in the first film roll FR1 mounted on the first shaft 111*a* of the first holding mechanism 110*a* in a state in which the trailing end portion F2T and the leading end portion F1L are sandwiched between the heater 162 and the first guide member 119 secured to the arm 122*a*.

(2-3-2) First Clamp and Second Clamp

The first clamp 163 and the second clamp 164 are disposed along the conveyance path of the film F when the film F is fed to the bag-making and packaging unit 200. The first clamp 163 and the second clamp 164 are members that clamp and secure the film F to inhibit misalignment of the trailing end portion of the film F of the used film roll FR after the trailing end portion of the film F of the used film roll FR has been positionally adjusted to the splicing position of the heater 162. The operations of the first clamp 163 and the second clamp 164 (the clamping and unclamping of the film F) are controlled by activating and deactivating a first clamp drive mechanism 163*a* and a second clamp drive mechanism 164*a*, respectively. It will be noted that the first clamp drive mechanism 163*a* and the second clamp drive mechanism 164*a* may be mechanisms that utilize air pressure as a drive source or may be mechanisms that utilize motors as a drive source.

(2-3-3) Knife

The knife 166 is a member that cuts unnecessary film F after the trailing end portion of the film F of the used film roll FR and the leading end portion of the film F of the replacement film roll FR have been spliced together by the heater 162 (see FIG. 9). Execution of the cutting by the knife 166 and the stopping of the cutting by the knife 66 are controlled by activating and deactivating a knife drive mechanism 166*a*. It will be noted that the knife drive mechanism 166*a* may be a mechanism that utilizes air pressure as a drive source or may be a mechanism that utilizes a motor as a drive source.

It will be noted that the bag-making and packaging apparatus 1000 has a knife activation detection sensor 166*b* for detecting that the knife 166 has been activated (in this embodiment, that the knife 166 has been driven downward to cut the film F) (see FIG. 3). The knife activation detection sensor 166*b* may be disposed on the same side as the knife 166 (in this embodiment, the upper side where the splicing device 160 and the like are disposed) or may be disposed on the first guide member 119 side.

The knife activation detection sensor 166*b* is, for example, a photoelectric sensor. However, regarding the type of the knife activation detection sensor 166*b*, it suffices for the sensor to be capable of detecting the movement of the knife 166, and the sensor may also be an inductive or an electrostatic capacitive proximity sensor, for example.

(2-3-4) Pinch Roller

The pinch roller 168 pinches the film F between itself and another fixed roller and conveys the film F by rotating. The pinch roller 168 conveys the film F of the used film roll FR in a first direction D1 (see FIG. 9) so that the trailing end portion of the film F of the used film roll FR heads toward the film splicing position where splicing to the leading end portion of the film F of the new replacement film roll FR is performed by the heater 162. The pinch roller 168 is a mechanism capable of changing the conveyance speed of the film F.

The pinch roller 168 will now be described in greater detail taking as an example the case shown in FIG. 9 where the second film roll FR2 is the used film roll FR and the first film roll FR1 is the new replacement film roll FR.

The pinch roller 168 is pushed, by a pinch roller air cylinder 168*a*, against a fixed roller 112 of the first holding mechanism 110*a* (in FIG. 9, a fixed roller 112*b* disposed uppermost among the three fixed rollers 112) at the timing when positional adjustment of the trailing end portion of the film F of the used film roll FR (here, the trailing end portion F2T of the second film F2 of the second film roll FR2) is performed. As a result, the second film F2 is pinched between the pinch roller 168 and the fixed roller 112*b*. In this state, the pinch roller 168 is rotated clockwise (see the arrow in FIG. 9) as seen in a right side view by a pinch roller drive mechanism 168*b*. The pinch roller drive mechanism 168*b* is, for example, a servo motor. When the pinch roller 168 is rotated by the pinch roller drive mechanism 168*b*, the second film F2 is conveyed in the first direction D1 toward the second film roll FR2 (in the opposite direction of the direction in which the second film F2 is conveyed at the time of the bag-making and packaging operation). The pinch roller 168 conveys the second film F2 of the second film roll FR2 in the first direction D1 until the trailing end portion F2T of the second film F2 of the second film roll FR2 reaches the film splicing position where splicing to the leading end portion F1L of the first film F1 of the first film roll FR1 is performed by the heater 162. The way in which the driving of the pinch roller 168 by the pinch roller drive mechanism 168*b* is controlled is described later.

(2-3-5) Trailing End Portion Position Adjustment Sensors

The trailing end portion position adjustment first sensor 152 and the trailing end portion position adjustment second sensor 154 are sensors that detect, in a state in which the film F is being conveyed, the registration marks M for positional adjustment added to the film F of the used film roll FR.

The trailing end portion position adjustment first sensor 152 and the trailing end portion position adjustment second sensor 154 are disposed along the path on which the film F is conveyed by the pinch roller 168. In particular, the trailing end portion position adjustment first sensor 152 and the trailing end portion position adjustment second sensor 154 are disposed along the conveyance path of the film F on the side of the printed surface Fa of the film F conveyed by the pinch roller 168. The trailing end portion position adjustment second sensor 154 detects, on the downstream side of the trailing end portion position adjustment first sensor 152 in the direction in which the film F is conveyed by the pinch roller 168 (the first direction D1), the registration marks M for positional adjustment added to the film F.

The trailing end portion position adjustment first sensor 152 and the trailing end portion position adjustment second sensor 154 are, for example, registration mark sensors. However, the type of the trailing end portion position adjustment first sensor 152 and the trailing end portion position adjustment second sensor 154 is not limited to registration mark sensors and, for example, may also be sensors utilizing cameras.

The way in which the driving of the pinch roller 168 by the pinch roller drive mechanism 168*b* is controlled utilizing the trailing end portion position adjustment first sensor and the trailing end portion position adjustment second sensor is described later.

(2-3-6) Cooling Air Electromagnetic Valve

The cooling air electromagnetic valve 161*a* is an electromagnetic valve for controlling the execution and stopping of the blowing-out of air from an air outlet 161 formed in the neighborhood of the heater 162. The air blown out from the air outlet 161 cools the part of the film F spliced by the heater 162.

(2-4) Control Unit

The control unit 300 controls the operations of each part of the bag-making and packaging apparatus 1000 (the various configurations of the bag-making and packaging unit 200 and the film feeding unit 100).

The control unit 300 has a microcomputer that has parts such as a CPU and a memory. The control unit 300 controls the operations of each part of the bag-making and packaging apparatus 1000 as a result of the CPU reading and executing programs stored in the memory.

It will be noted that a control unit may realize, by hardware such as a logic circuit or by a combination of hardware and software, functions that are the same as the functions that the control unit 300 of this embodiment exhibits.

The control unit 300 is electrically connected to, in a state in which it can send various types of signals to and receive various types of signals from, the devices configuring each part of the bag-making and packaging apparatus 1000. For this reason, in a case where a malfunction occurs in any of the parts configuring the bag-making and packaging apparatus 1000, the control unit 300 can detect the malfunction.

The control unit 300 receives the detection results of the leading end portion position adjustment sensor 142, the trailing end portion position adjustment first sensor 152, and the trailing end portion position adjustment second sensor 154. Furthermore, the control unit 300 receives the detection result of the encoder 188 (the angle of rotation of the shaft 184*a* connected to the arms 186 to which the movable rollers 185 are secured). The detection result of the encoder 188 is used in the control of the position of the movable rollers 185. The detection result of the encoder 188 may also be used in the detection of the trailing end of the film roll FR described later.

(3) CONTROL OF OPERATION OF BAG-MAKING AND PACKAGING APPARATUS 1000 BY CONTROL UNIT (3-1) Normal Operation The control unit 300 controls the operations of each part of the bag-making and packaging apparatus 1000 in the following way during normal operation in which the bag-making and packaging unit 200 performs the bag-making and packaging operation.

The control unit 300 controls the film conveyor belts 220 so that the sheet-like film F pulled out from the film roll FR is conveyed at a predetermined speed (a speed decided from, for example, the operating load of the bag-making and packaging apparatus 1000) using the holding mechanism motors 114*a*, 114*b* of the film drawing mechanism 116.

The control unit 300 controls the start-up and stopping of the holding mechanism motors 114*a*, 114*b* of the film drawing mechanism 116 and the speed at which the film roll FR is rotated by the holding mechanism motors 114*a*, 114*b* of the film drawing mechanism 116 based on the state of conveyance of the film F and the detection result of the encoder 188. That is, the control unit 300 controls the film drawing mechanism 116 to change the drawing speed of the film F at the time of the bag-making and packaging operation in the bag-making and packaging unit 200.

For example, the control unit 300 starts up and stops the holding mechanism motors 114*a*, 114*b* of the film drawing mechanism 116 drawing out the film F in accordance with the timing when the control unit 300 operates and stops the film conveyor belts 220. In other words, the control unit 300 changes the speed at which the film F is drawn by the holding mechanism motors 114*a*, 114*b* of the film drawing mechanism 116 based on the conveyance speed of the film conveyor belts 220 at the time of the bag-making and packaging operation in the bag-making and packaging unit 200.

Furthermore, the control unit 300 controls the speed at which the shafts 111*a*, 111*b* holding the film roll FR are rotated by the holding mechanism motors 114*a*, 114*b* of the film drawing mechanism 116 based on the detection result of the encoder 188. In other words, the control unit 300 changes the speed at which the film F is drawn by the holding mechanism motors 114*a*, 114*b* of the film drawing mechanism 116 based on the detection result of the encoder 188, namely, the position of the movable rollers 185, at the time of the bag-making and packaging operation in the bag-making and packaging unit 200.

Furthermore, the control unit 300 controls the movable roller mechanism air cylinder 187 so that the movable rollers 185 cause constant force to act on the film F that is being conveyed.

Furthermore, the control unit 300 controls the operations of the longitudinal sealing mechanism 230 and the transverse sealing mechanism 240 so that the longitudinal sealing mechanism 230 performs longitudinal sealing of the tubular film Ft at a predetermined timing and the transverse sealing mechanism 240 performs transverse sealing of the tubular film Ft at a predetermined timing.

(3-2) Auto-Feeding Function

Operations relating to the auto-feeding function of the bag-making and packaging apparatus 1000 are described below.

(3-2-1) Operation of Setting Replacement Film Roll

In a case where the control unit 300 utilizes the auto-feeding function, the operator sets the replacement film roll FR in the holding mechanism 110*a*, 110*b*. Here, the work of the operator when setting the replacement film roll FR in the holding mechanism 110*a*, 110*b* will be described. Furthermore, the operation of the bag-making and packaging apparatus 1000 in which the replacement film roll FR has been set in the holding mechanism 110*a*, 110*b* by the operator will also be jointly described.

It will be noted that here the work of the operator when setting the first film roll FR1 in the first holding mechanism 110*a* and the operation of the bag-making and packaging apparatus 1000 are described as an example. The operation of setting the second film roll FR2 in the second holding mechanism 110*b* is the same as the operation of setting the first film roll FR1 in the first holding mechanism 110*a*, so description thereof is omitted here.

First, the operator mounts the first film roll FR1 on the first shaft 111*a* of the first holding mechanism 110*a* disposed in the film roll setting position A1. Next, the operator pulls out the first film F1 from the first film roll FR1, puts the first film F1 along the upper surface of the first guide member 119, and then guides the first film F1 between the fixed rollers 112 and the movable roller 118 of the first film restraining mechanism 117. Moreover, the operator manually temporarily places, on the temporary placement surface 143*a* of the film temporary placement member 143, the neighborhood of the leading end portion of the film F pulled out from the film roll FR. Next, the operator operates the temporary restraining mechanism 144 to temporarily restrain the first film F1 that has been temporarily placed on the temporary placement surface 143*a* of the film temporary placement member 143. Thereafter, the operator operates switches 102 provided on the back side of the film feeding unit 100 to instruct the control unit 300 to align the leading end portion F1L of the first film F1.

The control unit 300, in response to the instruction to align the leading end portion F1L of the first film F1, activates the connection mechanism 111*a*1 of the first shaft 111*a* to connect and secure the first film roll FR1 to the first shaft 111*a*. Furthermore, the control unit 300 drives the air cylinder 118*a* to push the movable roller 118 against the fixed rollers 112 (in particular, the fixed roller 112*a* in the middle), sandwich the first film F1 between the movable roller 118 and the fixed rollers 112, and restrain the first film F1. As a result, misalignment of the first film F1 is inhibited. Next, the control unit 300 rotates the first holding mechanism motor 114*a* of the film drawing mechanism 116 to thereby rotate the first shaft 111*a* counter-clockwise as seen in a right side view. As a result, the first film F1 is taken up on the first film roll FR1, and the terminal end F1E of the first film F1 is conveyed to the leading end portion position adjustment sensor 142. The control unit 300 stops the conveyance of the first film F1 by the first holding mechanism motor 114*a* when the leading end portion position adjustment sensor 142 detects the registration mark M added to the first film F1 that is conveyed (the registration mark M printed on the printed surface F1*a* of the first film F1 and located in the neighborhood of the terminal end F1E of the first film F1). In this state, the leading end portion F1L of the first film F1 is disposed in the prescribed position. Summarizing the above, after the neighborhood of the leading end portion F1L of the first film F1 has been temporarily placed on the film temporary placement member 143, the control unit 300 when utilizing the auto-feeding function causes the first holding mechanism motor 114*a* to rotate the first film roll FR1 to thereby convey the first film F1 along a predetermined conveyance path. The control unit 300 conveys the first film F1 along the predetermined conveyance path until the leading end portion position adjustment sensor 142 detects that the leading end portion F1L of the first film F1 is positioned in the prescribed position.

With this, the control unit 300 ends the alignment of the leading end portion F1L of the first film F1.

Next, the moving mechanism 139 moves the first holding mechanism 110*a* from the film roll setting position A1 to the film roll standby position A3 before the leading end portion F1L of the first film F1 of the first film roll FR1 mounted on the first shaft 111*a* of the first holding mechanism 110*a* becomes connected by the heater 162 to the trailing end portion F2T of the second film F2 of the second film roll FR2 mounted on the second shaft 111*b* of the second holding mechanism 110*b*. In other words, the control unit 300 when utilizing the auto-feeding function controls the moving mechanism 139 (controls the frame rotation motor 138) to rotate the holding mechanism support frame 120 the predetermined angle and move the first holding mechanism 110*a* from the film roll setting position A1 to the film roll standby position A3 so that the leading end portion F1L of the first film F1 is disposed in the place where it becomes spliced by the heater 162. The first holding mechanism 110*a* that has been moved to the film roll standby position A3 stands by in that location, without particularly operating at all, until the trailing end of the second film F2 of the second film roll FR2 of the second holding mechanism 110*b* is detected.

It will be noted that it is preferred that, when the control unit 300 moves the first holding mechanism 110*a* from the film roll setting position A1 to the film roll standby position A3, the control unit 300 performs positional adjustment of the neighborhood of the terminal end FIE of the first film F1 by controlling the terminal end position adjustment air electromagnetic valve 146*a* to blow air from the terminal end position adjustment air nozzle 146 onto the neighborhood of the terminal end FIE on the leading end portion F1L side of the first film F1.

(3-2-2) Operation Relating to Auto-Splicing of Trailing End Portion of Film of Used Film Roll and Leading End Portion of Film of Replacement Film Roll The operation of the bag-making and packaging apparatus 1000 relating to the auto-splicing of the film rolls FR when utilizing the auto-feeding function will now be described. It will be noted that here description is given taking as an example a case where the second film roll FR2 is the used film roll (the film roll that had been used for bag-making and packaging) and the first film roll FR1 is the replacement film roll.

The auto-splicing of the film rolls FR is triggered by detection of the trailing end of the film roll FR that is in use.

The control unit 300 detects the trailing end of the second film roll FR2 based on the detection result of the encoder 188, for example. The control unit 300 detects the trailing end of the second film roll FR2 based on a physical quantity relating to the position of the movable rollers 185 that the encoder 188 detects, specifically, the angle of rotation of the shaft 184*a* to which are connected the arms 186 to which the movable rollers 185 are secured.

During the normal operation of the bag-making and packaging apparatus 1000, the position of the movable rollers 185 is controlled to a predetermined position (a predetermined region). However, once the trailing end of the film roll FR is reached, the film F cannot be pulled out any further from the film roll FR, so even if the control unit 300 controls the operations of each part of the bag-making and packaging apparatus 1000, the movable rollers 185 are lifted up by the film F and move upward beyond the predetermined region. Thus, the control unit 300 determines whether or not the angle of rotation of the shaft 184*a* that the encoder 188 detects has exceeded a predetermined threshold value (whether or not the arms 186 have rotated to a position they cannot take during normal operation). Then, in a case where the angle of rotation of the shaft 184*a* has exceeded the predetermined threshold value, the control unit 300 detects the trailing end of the film roll FR.

It will be noted that although in this embodiment the trailing end of the film roll FR is detected using the encoder 188 as a sensor, the detection of the trailing end of the film roll FR is not limited to this way. For example, in another configuration, a photoelectric sensor 190 (see FIG. 2) disposed in the neighborhood of the film feeding positions A2, A4 may also detect the trailing end of the film roll FR by detecting an end mark (not shown in the drawings) added to the film F and indicating the trailing end of the film roll FR (in FIG. 4, the photoelectric sensor 190 is omitted).

The control unit 300 stops the operations of the film conveyor belts 220, the longitudinal sealing mechanism 230, and the transverse sealing mechanism 240 when the sensor such as the encoder 188 or the photoelectric sensor 190 has detected the trailing end of the film roll FR. Furthermore, the control unit 300 stops the operation of the second holding mechanism motor 114*b* of the film drawing mechanism 116 when the sensor such as the encoder 188 or the photoelectric sensor 190 has detected the trailing end of the film roll FR.

Furthermore, when the sensor such as the encoder 188 or the photoelectric sensor 190 has detected the trailing end of the film roll FR, the control unit 300 drives the pinch roller air cylinder 168*a* to push the pinch roller 168 against one of the fixed rollers 112 (the fixed roller 112*b*) of the first holding mechanism 110*a* to thereby pinch the second film F2 between the pinch roller 168 and the fixed roller 112*b*. Moreover, the control unit 300 drives the pinch roller drive mechanism 168*b* clockwise as in FIG. 9 as seen in a right side view to start conveyance of the second film F2 in the first direction D1 (the opposite direction of the conveyance direction of the film F during normal operation). The fixed roller 112*c* disposed lowermost and frontmost in the state shown in FIG. 9 among the fixed rollers 112 of the first holding mechanism 110*a* is utilized as a guide during the conveyance of the second film F2 by the pinch roller 168.

At this time, the control unit 300 controls the pinch roller drive mechanism 168*b* to convey the second film F2 at a conveyance speed V1 in the first direction D1 until the trailing end portion position adjustment first sensor 152 detects the registration mark M printed on the printed surface F2*a* of the second film F2. After the trailing end portion position adjustment first sensor 152 has detected the registration mark M, the control unit 300 conveys the second film F2 at a conveyance speed V2 in the first direction D1. Then, when the trailing end portion position adjustment second sensor 154 detects the registration mark M, the control unit 300 judges that the trailing end portion F2T of the second film F2 has reached the film splicing position where splicing is performed by the heater 162. Then, the control unit 300 performs control that stops the pinch roller drive mechanism 168*b* to stop the conveyance of the second film F2 by the pinch roller 168.

When the trailing end portion position adjustment second sensor 154 detects the registration mark M printed on the printed surface F2*a* of the second film F2 and, based on this, the conveyance of the second film F2 by the pinch roller 168 is stopped, the trailing end portion F2T of the second film F2 is in the position where it becomes spliced by the heater 162. In this state, the control unit 300 drives the first clamp drive mechanism 163*a* and the second clamp drive mechanism 164*a* to restrain the second film F2 with the first clamp 163 and the second clamp 164 in order to inhibit misalignment of the trailing end portion F2T of the second film F2. Furthermore, the control unit 300 controls the heater 162 to splice together the trailing end portion F2T of the second film F2 and the leading end portion F1L of the first film F1. For example, the control unit 300 executes, at generally the same timing, the driving of the first clamp drive mechanism 163*a* and the second clamp drive mechanism 164*a* and the splicing together of the trailing end portion F2T of the second film F2 and the leading end portion F1L of the first film F1 by the heater 162. Next, the control unit 300 drives the knife drive mechanism 166*a* to cut the film F with the knife 166 in order to cut away unnecessary first film F1 and second film F2 from the film F used in normal operation.

Next, the control unit 300 controls the second clamp drive mechanism 164*a* to cancel the restraint of the second film F2 by the second clamp 164. Furthermore, the control unit 300 controls the cooling air electromagnetic valve 161*a* to blow air from the air outlet 161 onto the place where the first film F1 and the second film F2 have been spliced together. Moreover, the control unit 300 controls the first clamp drive mechanism 163*a* to cancel the restraint of the film F by the first clamp 163. Furthermore, the control unit 300 controls the pinch roller air cylinder 168*a* to move the pinch roller 168 away from the fixed roller 112*b* and cancel the restraint of the film F by the pinch roller 168.

Thereafter, the control unit 300 has the moving mechanism 139 move the first holding mechanism 110*a* positioned in the film roll standby position A3 to the film feeding position A2 and activates the film conveyor belts 220, the longitudinal sealing mechanism 230, and the transverse sealing mechanism 240 to return to normal operation. It will be noted that when the first holding mechanism 110*a* is moved to the film feeding position A2, the second holding mechanism 110*b* moves to the film roll setting position A1. Then, a new (replacement) second film roll FR2 may be set in the second holding mechanism 110*b*.

In this way, when the control unit 300 utilizes the auto-feeding function, the control unit 300 feeds to the bag-making and packaging unit 200 to the film F spliced by the splicing device 160 to take the place of the film F currently being fed to the bag-making and packaging unit 200. The control unit 300 allows the bag-making operation to continue by utilizing the auto-feeding function.

(4) NON-AUTO-FEEDING MODE

The operation of the bag-making and packaging apparatus 1000 controlled by the control unit 300 utilizing the auto-feeding function has been described above.

However, in a case where the control unit 300 is utilizing the auto-feeding function and at least one of the film feeding unit 100 and the splicing device 160 is malfunctioning, there is the concern that the bag-making operation will stop. It will be noted that "a case where at least one of the film feeding unit 100 and the splicing device 160 is malfunctioning" here means a case where at least one of the parts configuring the film feeding unit 100 and the parts configuring the splicing device 160 is malfunctioning.

For example, in a case where the first holding mechanism motor 114*a* or the second holding mechanism motor 114*b* is malfunctioning, the feeding of the film F stops. Alternatively, in a case where the frame rotation motor 138 is malfunctioning, the first holding mechanism 110*a* and the second holding mechanism 110*b* cannot be moved to the film roll standby position A3, for example. In other words, the leading end portion of the film F cannot be moved to the splicing position where it is spliced by the heater 162. Alternatively, in a case where the photoelectric sensors 408A, 408B are malfunctioning, the posture of the holding mechanism support frame 120 cannot be detected. For this reason, there is the concern that the leading end portion of the film F will be moved to a position not aligned with the splicing position where it is spliced by the heater 162. Alternatively, in a case where the pinch roller 168 is malfunctioning, the trailing end portion of the film F cannot be moved to the splicing position where it is spliced by the heater 162. Alternatively, in a case where the heater 162 is malfunctioning, the trailing end portion of the film F and the leading end portion of the film F cannot be spliced together. Alternatively, in a case where the knife 166 is malfunctioning, unnecessary film F cannot be cut after the trailing end portion of the film F and the leading end portion of the film F have been spliced together by the heater 162.

In this way, in a case where at least one of the parts configuring the film feeding unit 100 and the parts configuring the splicing device 160 is malfunctioning, there is the concern that the bag-making operation will stop.

Here, the bag-making and packaging apparatus 1000 pertaining to this embodiment has, as operating modes, the auto-feeding mode that utilizes the auto-feeding function and the non-auto-feeding mode that does not utilize the auto-feeding function. The control unit 300 of the bag-making and packaging apparatus 1000 pertaining to this embodiment stops the auto-feeding function and executes the non-auto-feeding mode when it judges that at least one of the film feeding unit 100 and the splicing device 160 is malfunctioning in a case where the control unit 300 is utilizing the auto-feeding function (in other words, in the auto-feeding mode). More specifically, the control unit 300 stops the auto-feeding function and executes the non-auto-feeding mode when it judges that at least one of the first holding mechanism motor 114*a*, the second holding mechanism motor 114*b*, the frame rotation motor 138, the photoelectric sensors 408A, 408B, the pinch roller 168, the heater 162, and the knife 166 is malfunctioning.

The non-auto-feeding mode is an operating mode that allows the bag-making operation to be continued by the bag-making and packaging unit 200 and the film roll holding unit that is operable among the plural film roll holding units.

It will be noted that "the film roll holding unit that is operable" here means the film roll holding unit that can draw the film F to the bag-making and packaging unit 200. This is described in detail below.

(4-1) Changing the Operating Mode

Figure 12:
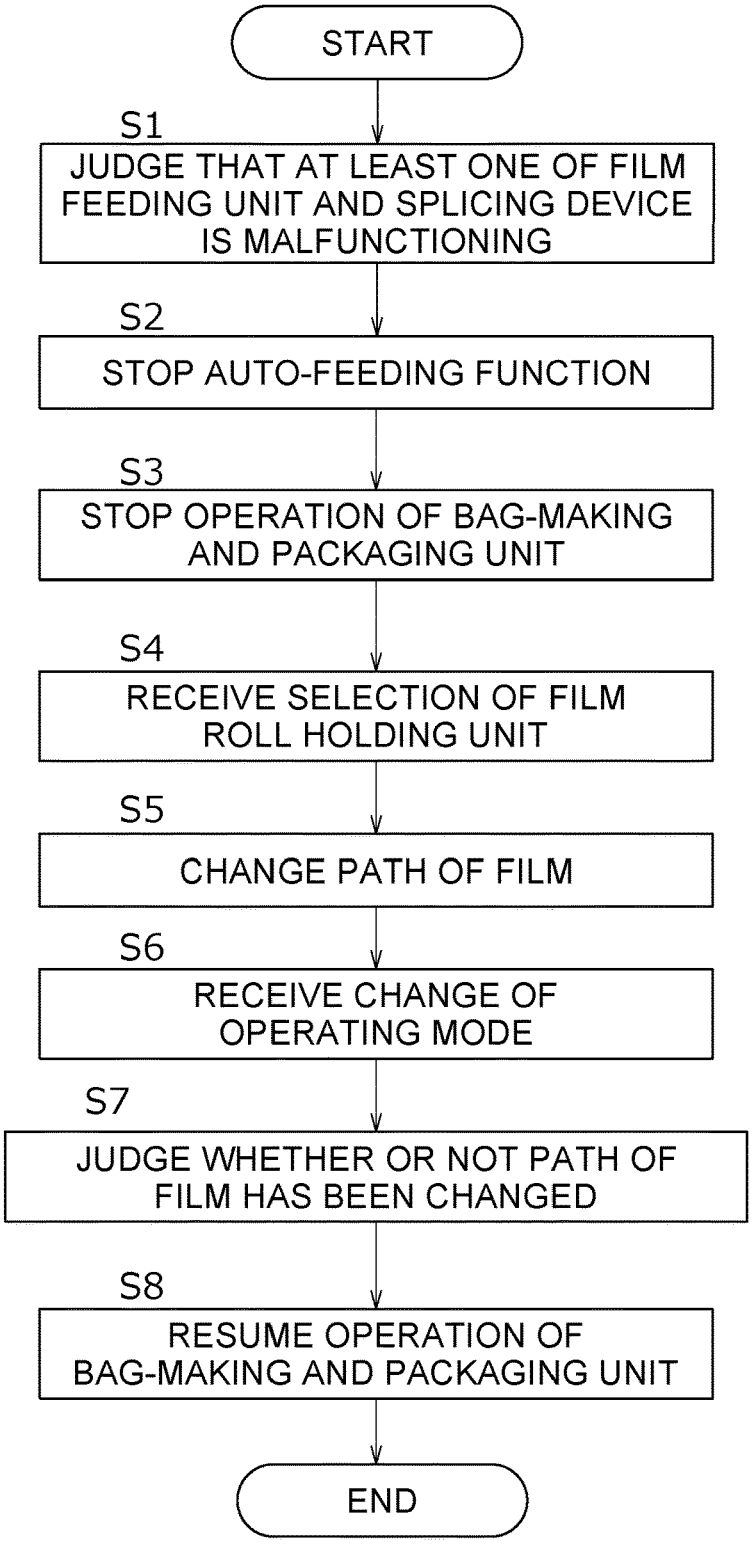
FIG. 12 is a flowchart for describing a flow until an operating mode is changed.

A flow until the operating mode of the bag-making and packaging apparatus 1000 switches from the auto-feeding mode to the non-auto-feeding mode will now be described with reference to the flowchart shown in FIG. 12. Here, description is given supposing a case where the control unit 300 utilizing the auto-feeding function has detected that the second holding mechanism motor 114*b* of the second holding mechanism 110*b* disposed in the film roll setting position A1 is malfunctioning. It will be noted that the flowchart in FIG. 12 is an example and may be changed as appropriate. For example, the order of the steps may be changed, some steps may be executed in parallel with other steps, and other steps may be added anew to the extent that there are no incompatibilities.

In step S1 the control unit 300 utilizing the auto-feeding function judges that at least one of the film feeding unit 100 and the splicing device 160 is malfunctioning. Here, the control unit 300 judges that the second holding mechanism motor 114*a* is malfunctioning. As described above, the control unit 300 is electrically connected to, in a state in which it can send various types of signals to and receive various types of signals from, the devices configuring each part of the bag-making and packaging apparatus 1000. For this reason, the control unit 300 can judge that the second holding mechanism 110*b* is malfunctioning based on the various types of signals sent from each part of the bag-making and packaging apparatus 1000.

In step S2 the control unit 300 stops the auto-feeding function.

In step S3 the control unit 300 stops the operation of the bag-making and packaging unit 200. In accompaniment with the operation of the bag-making and packaging unit 200 stopping, the feeding of the film F by the film feeding unit 100 and the auto-splicing by the splicing device 160 stop.

In step S4 the control unit 300 receives from the operator a selection of the film roll holding unit to operate in the non-auto-feeding mode. In other words, the operator selects which film roll holding unit among the first holding mechanism 110*a* and the second holding mechanism 110*b* to operate in the non-auto-feeding mode.

Figure 13:
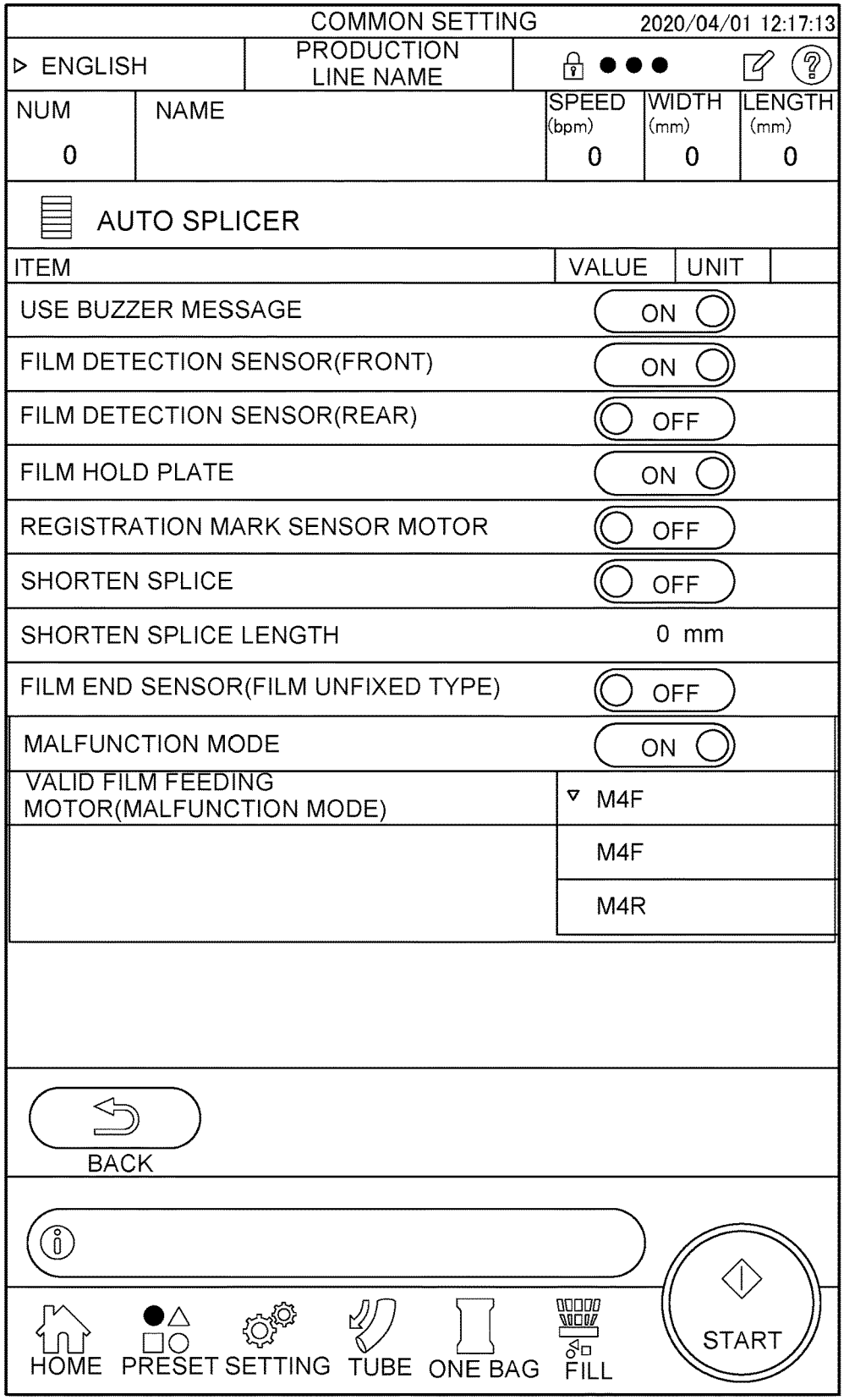
FIG. 13 is an example of a screen displayed on an operating mode switching unit.

Here, the selection of the film roll holding unit to operate in the non-auto-feeding mode is performed by selecting the motor that rotates the film roll. The selection of the motor that rotates the film roll can be input using the liquid crystal display 96, for example. FIG. 13 is an example of a screen displayed on the liquid crystal display 96. For example, the operator selects the motor to operate in the non-auto-feeding mode from the item "Valid Film Feeding Motor (Malfunction Mode)" shown in FIG. 13. Here, in a case where, for example, the operator selects the first holding mechanism motor 114*a*, the first holding mechanism 110*a* operates in the non-auto-feeding mode. Conversely, in a case where the operator selects the second holding mechanism motor 114*b*, the second holding mechanism 110*b* operates in the non-auto-feeding mode.

However, in a case where either motor of the first holding mechanism motor 114*a* and the second holding mechanism motor 114*b* is malfunctioning, the malfunctioning motor cannot be selected. Consequently, in this case, the film roll holding unit to operate in the non-auto-feeding mode is automatically decided to be the first holding mechanism 110*a*.

In step S5 the control unit 300 changes the path of the film F. The path of the film F includes a first path FP1 and a second path FP2. The first path FP1 is a path when utilizing the splicing device 160. More specifically, the first path FP1 is a path used when the control unit 300 feeds the film F utilizing the splicing device 160 (see FIG. 9).

The second path FP2 is a path different from the first path FP1 which is the path when utilizing the splicing device 160. In other words, the second path FP2 is a path used when the control unit 300 feeds the film F without utilizing the splicing device 160. The second path FP2 is, for example, a path of the film F that extends from the film roll setting position A1 toward the plural rollers 170 (see FIG. 14). In this way, in the bag-making and packaging apparatus 1000 pertaining to this embodiment, when the operating mode switches to the non-auto-feeding mode, the path of the film F is changed to the second path FP2.

In order to change the path of the film F to the second path FP2, the control unit 300 activates the frame rotation motor 138. In this case, the first holding mechanism 110*a* is selected as the film roll holding unit to operate in the non-auto-feeding mode. In this case, the control unit 300 activates the frame rotation motor 138 so that the first holding mechanism 110*a* moves to the film roll setting position A1. It will be noted that in a case where the frame rotation motor 138 is malfunctioning, the first holding mechanism 110*a* is manually moved by the operator to the film roll setting position A1. Furthermore, in a case where the frame rotation motor 138 is malfunctioning, the operator uses a stopper or the like (not shown in the drawings) to secure the first holding mechanism 110*a* in the film roll setting position A1. It will be noted that in step S5 the bag-making operation remains stopped. For this reason, even in a case where the operator manually moves the first holding mechanism 110*a*, the safety of the operator is ensured.

In step S6 the control unit 300 receives from the operator an operation for switching the operating mode. The control unit 300 can switch the operating mode to the non-auto-feeding mode by receiving the operation for switching the operating mode. The operation for switching the operating mode can be received from the operating mode switching unit 96*a*. In this embodiment, the operating mode switching unit 96*a* is the liquid crystal display 96. FIG. 13 is an example of a screen displayed on the liquid crystal display 96 functioning as the operating mode switching unit 96*a*. For example, the operator can switch the operating mode to the non-auto-feeding mode from the item "Malfunction Mode" on the operation screen shown in FIG. 13. It will be noted that in this embodiment the operating mode switching unit 96*a* is controlled so that it can accept the operation for switching to the non-auto-feeding mode only when the operation of the bag-making and packaging unit 200 is stopped. Furthermore, in step S6 the bag-making operation remains stopped. For this reason, the safety of the operator when the operator inputs to the operating mode switching unit 96*a* the operation for switching the operating mode is ensured.

In step S7 the control unit 300 judges whether or not the path of the film F has been changed from the first path FP1 to the second path FP2. The control unit 300 pertaining to this embodiment judges that the path of the film F has been changed from the first path FP1 to the second path FP2 by receiving the operation for switching the operating mode. It will be noted that the bag-making and packaging apparatus 1000 may also be equipped with a sensor and/or a camera capable of detecting the path of the film F. In this case, the control unit 300 may judge whether or not the path of the film F has been changed from the first path FP1 to the second path FP2 based on a signal sent from the sensor and/or the camera.

In step S8 the control unit 300 resumes the operation of the bag-making and packaging unit 200. In other words, in step S8 the control unit 300 resumes the bag-making operation.

In this way, the operating mode of the bag-making and packaging apparatus 1000 switches from the auto-feeding mode to the non-auto-feeding mode. The bag-making and packaging apparatus 1000 in the non-auto-feeding mode can perform the bag-making operation in substantially the same way as when it performs the bag-making operation in the auto-feeding mode except that the path of the film F is changed to the second path FP2. In other words, the bag-making and packaging apparatus 1000 can continue the bag-making operation even in the non-auto-feeding mode. For this reason, in the bag-making and packaging apparatus 1000 pertaining to this embodiment, a reduction in productivity is inhibited even in a case where a malfunction occurs in at least one of the film feeding unit 100 and the splicing device 160.

(4-2) Operation of Setting Replacement Film Roll in Non-Auto-Feeding Mode

Next, the operation of replacing the film roll FR in the non-auto-feeding mode will be described. It will be noted that, below, description is given supposing a case where the first holding mechanism 110*a* is selected as the film roll holding unit to operate in the non-auto-feeding mode.

The control unit 300 in the non-auto-feeding mode stops the operations of the film conveyor belts 220, the longitudinal sealing mechanism 230, and the transverse sealing mechanism 240 when the sensor such as the encoder 188 or the photoelectric sensor 190 has detected the trailing end of the film roll FR. Furthermore, the control unit 300 stops the operation of the first holding mechanism motor 114*a* when the sensor such as the encoder 188 or the photoelectric camera 190 has detected the trailing end of the film roll FR. Moreover, the control unit 300 uses a notification unit or the like (not shown in the drawings) to notify the operator that the film roll FR needs to be replaced when the sensor such as the encoder 188 or the photoelectric sensor 190 has detected the trailing end of the film roll FR. At this time, the control unit 300 does not rotate the holding mechanism support frame 120. In other words, the control unit 300 does not move the first holding mechanism 110*a* from the film roll setting position A1.

Next, the operator detaches the used film roll FR from the first shaft 111*a* of the first holding mechanism 110*a* disposed in the film roll setting position A1 and mounts the replacement film roll FR. At this time, the splicing together of the trailing end portion of the used film roll FR and the leading end portion of the replacement film roll FR is manually performed by the operator. Furthermore, the operator manually cuts unnecessary film F after splicing together the trailing end portion of the used film roll FR and the leading end portion of the replacement film roll FR.

Thereafter, the operator operates the switches 102 provided on the back side of the film feeding unit 100 to input the fact that the operator has finished the work of replacing the film roll FR. The control unit 300 receiving the input activates the film conveyor belts 220, the longitudinal sealing mechanism 230, and the transverse sealing mechanism 240 to resume the bag-making operation in the non-auto-feeding mode. In this way, the bag-making operation in the non-auto-feeding mode continues.

(5) CHARACTERISTICS 5-1

The bag-making and packaging apparatus 1000 pertaining to this embodiment includes the bag-making and packaging unit 200, the film feeding unit 100, the splicing device 160, and the control unit 300. The bag-making and packaging unit 200 forms the sheet-like film F into a tubular shape. The bag-making and packaging unit 200 seals the film F that has been formed into the tubular shape to thereby form the film F into bags. The film feeding unit 100 has plural film roll holding units that hold the film rolls FR in which the sheet-like film F is wound. The film feeding unit 100 feeds to the bag-making and packaging unit 200 the film F that is drawn from one film roll FR. The splicing device 160 automatically splices together the film F being fed from the film feeding unit 100 and the film F that is wound in another film roll FR. The control unit 300 allows the bag-making operation to continue by utilizing the auto-feeding function that feeds to the bag-making and packaging unit 200 the film F spliced by the splicing device 160 to take the place of the film F currently being fed to the bag-making and packaging unit 200. When the control unit 300 judges that at least one of the film feeding unit 100 and the splicing device 160 is malfunctioning in a case where the control unit 300 is utilizing the auto-feeding function, the control unit 300 stops the auto-feeding function and executes the non-auto-feeding mode. The non-auto-feeding mode allows the bag-making operation to be continued by the bag-making and packaging unit 200 and the film roll holding unit that is operable among the plural film roll holding units.

According to this configuration, when the control unit 300 judges that at least one of the film feeding unit 100 and the splicing device 160 is malfunctioning, the control unit 300 stops the auto-feeding function and executes the non-auto-feeding mode. The non-auto-feeding mode allows the bag-making operation to be continued by the bag-making and packaging unit 200 and the film roll holding unit that is operable among the plural film roll holding units. For this reason, in the bag-making and packaging apparatus 1000 pertaining to this embodiment, a reduction in productivity is inhibited even in a case where a malfunction occurs in at least one of the film feeding unit 100 and the splicing device 160. It will be noted that in this embodiment the first holding mechanism 110*a* and the second holding mechanism 110*b* correspond to the film roll holding units.

5-2

The bag-making and packaging apparatus 1000 pertaining to this embodiment further includes the operating mode switching unit 96*a*. The operating mode switching unit 96*a* at least receives an operation for switching the operating mode from an operator.

5-3

In the bag-making and packaging apparatus 1000 pertaining to this embodiment, when the control unit 300 judges that at least one of the film feeding unit 100 and the splicing device 160 is malfunctioning in a case where the control unit 300 is utilizing the auto-feeding function, the control unit 300 stops the auto-feeding function and stops the operation of the bag-making and packaging unit 200.

According to this configuration, when the control unit 300 judges that at least one of the film feeding unit 100 and the splicing device 160 is malfunctioning, the operation of the bag-making and packaging unit 200 stops. For this reason, in the bag-making and packaging apparatus 1000 pertaining to this embodiment, the safety of the operator in a case where a malfunction occurs in at least one of the film feeding unit 100 and the splicing device 160 is ensured.

Furthermore, because the operation of the bag-making and packaging unit 200 stops in a case where at least one of the film feeding unit 100 and the splicing device 160 is malfunctioning, the operator can easily perceive that at least one of the film feeding unit 100 and the splicing device 160 is malfunctioning.

5-4

In the bag-making and packaging apparatus 1000 pertaining to this embodiment, when the control unit 300 stops the operation of the bag-making and packaging unit 200, the control unit 300 switches to the non-auto-feeding mode in a case where the operating mode switching unit 96*a* that at least receives an operation for switching the operating mode from the operator has received an operation to switch to the non-auto-feeding mode.

According to this configuration, the switch to the non-auto-feeding mode is performed after the operation of the bag-making and packaging unit 200 has stopped. For this reason, in the bag-making and packaging apparatus 1000 pertaining to this embodiment, the safety of the operator when switching the bag-making and packaging apparatus 1000 to the non-auto-feeding mode is ensured.

5-5

In the bag-making and packaging apparatus 1000 pertaining to this embodiment, when the control unit 300 stops the operation of the bag-making and packaging unit 200, the control unit 300 resumes the operation of the bag-making and packaging unit 200 in a case where the path of the film F fed to the bag-making and packaging unit 200 has been changed from the first path FP1 to the second path FP2. The first path FP1 is a path when utilizing the splicing device. The second path FP2 is a path different from the first path FP1.

According to this configuration, the operation of the bag-making and packaging unit 200 resumes after the path of the film has been changed. For this reason, in the bag-making and packaging apparatus 1000 pertaining to this embodiment, the safety of the operator when changing the path of the film F in the bag-making and packaging apparatus 1000 is ensured.

5-6

In the bag-making and packaging apparatus 1000 pertaining to this embodiment, the film feeding unit 100 includes at least one of motors that rotate the film rolls FR, a motor that rotates a frame that supports the film roll holding units, and sensors that detect the posture of the frame that supports the film roll holding units. The splicing device 160 includes at least one of the heater 162 for applying heat to and thermocompressively bonding the film F, a cutting member for cutting the film F, and the pinch roller 168 for conveying the film F.

According to this configuration, when the control unit 300 judges that at least one of the motors that rotate the film rolls FR, the motor that rotates the frame that supports the film roll holding units, the sensors that detect the posture of the film roll holding units, the heater 162 for applying heat to and thermocompressively bonding the film, the cutting member for cutting the film F, and the pinch roller 168 for conveying the film F is malfunctioning, the control unit 300 stops the auto-feeding function and executes the non-auto-feeding mode. For this reason, in the bag-making and packaging apparatus 1000 pertaining to this embodiment, a reduction in productivity is inhibited.

It will be noted that in this embodiment the first holding mechanism motor 114*a* and the second holding mechanism motor 114*b* correspond to the motors that rotate the film rolls FR. Furthermore, the holding mechanism support frame 120 corresponds to the frame that supports the film roll holding units. Furthermore, the frame rotation motor 138 corresponds to the motor that rotates the frame that supports the film roll holding units. Furthermore, the photoelectric sensors 408A, 408B correspond to the sensors that detect the posture of the film roll holding units. Furthermore, the knife 166 corresponds to the cutting member for cutting the film F.

(6) EXAMPLE MODIFICATIONS

Example modifications of the embodiment are described below. The example modifications may be combined as appropriate to the extent that they are not mutually incompatible.

(6-1) Example Modification A

In the above embodiment, an example of the bag-making and packaging apparatus 1000 in which the operating mode switches to the non-auto-feeding mode as a result of the operating mode switching unit 96*a* receiving an operation for switching the operating mode from the operator was described. However, examples of the bag-making and packaging apparatus are not limited to this.

For example, the bag-making and packaging apparatus may also be equipped with a control unit that automatically switches the operating mode to the non-auto-feeding mode when it judges that at least one of the film feeding unit 100 and the splicing device 160 is malfunctioning.

Furthermore, in the above embodiment, an example of the bag-making and packaging apparatus 1000 that receives from the operator a selection of the film roll holding unit to operate in the non-auto-feeding mode was described. However, examples of the bag-making and packaging apparatus are not limited to this, and the bag-making and packaging apparatus may also be equipped with a control unit that automatically decides the film roll holding unit to operate in the non-auto-feeding mode.

(6-2) Example Modification B

Although this is not described in the above embodiment, it is preferred that the operator set a breaker of the heater 162 to OFF beforehand when performing the operation for switching the operating mode. More preferably, the operator sets the set temperature of the heater 162 to 0° C. beforehand when performing the operation for switching the operating mode.

In the bag-making and packaging apparatus pertaining to this example modification, the safety of the operator is further ensured. It will be noted that these settings relating to the heater may also be automatically set by the control unit 300 at the same time that the operating mode is switched to the non-auto-feeding mode.

(6-3) Example Modification C

Although this is not described in the above embodiment, it is preferred that when the control unit 300 judges that at least one of the film feeding unit 100 and the splicing device 160 is malfunctioning, the control unit 300 notify the operator, using the liquid crystal display 96 for example, that at least one of the film feeding unit 100 and the splicing device 160 is malfunctioning.

According to this configuration, the operator can promptly switch the operating mode to the non-auto-feeding mode. For this reason, a reduction in the productivity of the bag-making and packaging apparatus is further inhibited.

(6-4) Example Modification D

In the above embodiment, the bag-making and packaging apparatus 1000 equipped with the control unit 300 that stops the auto-feeding function and executes the non-auto-feeding mode when it judges that at least one of the first holding mechanism motor 114*a*, the second holding mechanism motor 114*b*, the frame rotation motor 138, the photoelectric sensors 408A, 408B, the pinch roller 168, the heater 162, and the knife 166 is malfunctioning was described. However, examples of the control by the control unit 300 are not limited to this.

For example, the control unit 300 may also execute the non-auto-feeding mode in a case where a part that configures the film feeding unit 100 or the splicing device 160 but does not correspond to the above parts is malfunctioning.

Consequently, the control unit 300 may also execute the non-auto-feeding mode in a case where, for example, the first holding mechanism 110*a* is malfunctioning. Alternatively, the control unit 300 may also execute the non-auto-feeding mode in a case where the frame rotation transmission mechanism 137 is malfunctioning. Alternatively, the control unit 300 may also execute the non-auto-feeding mode in a case where the first clamp 163 is malfunctioning.

(6-5) Example Modification E

In the above embodiment, the bag-making and packaging apparatus 1000 equipped with the control unit 300 that stops the auto-feeding function and executes the non-auto-feeding mode when it judges that at least one of the first holding mechanism motor 114*a*, the second holding mechanism motor 114*b*, the frame rotation motor 138, the photoelectric sensors 408A, 408B, the pinch roller 168, the heater 162, and the knife 166 is malfunctioning was described. However, examples of the control by the control unit 300 are not limited to this. For example, the control unit 300 can stop the auto-feeding function and execute the non-auto-feeding mode even in a case where it judges that a part other than those described above is malfunctioning. Specifically, the control unit 300 may also execute the non-auto-feeding mode in a case where a circuit board or the like of the microcomputer that the control unit 300 has is malfunctioning and the control unit 300 cannot control operation relating to the auto-feeding function.

(7) OTHER EMBODIMENTS

An embodiment of the bag-making and packaging apparatus pertaining to the invention has been described above, but it will be understood that various changes in the form and details may be made without departing from the spirit and scope of the claims.

The invention is not limited to the above embodiment as is. The invention can be embodied by modifying its constituent elements at the stage of implementation to the extent that doing so does not depart from the spirit of the invention. Furthermore, various inventions can be formed by appropriate combinations of multiple constituent elements disclosed in the above embodiment. For example, some constituent elements may be omitted from all the constituent elements described in the embodiment. Moreover, the constituent elements may be combined as appropriate with different embodiments. Therefore, this embodiment is to be construed as merely illustrative and not limited in any way, and thus any modifications apparent to one skilled in the art are intended to be included in the embodiment.

This invention can be widely applied to bag-making and packaging apparatus and is useful.

REFERENCE SIGNS LIST

96*a* Operating Mode Switching Unit
100 Film Feeding Unit

114*a* First Holding Mechanism Motor (motor that rotates film roll)
114*b* Second Holding Mechanism Motor (motor that rotates film roll)
138 Frame Rotation Motor (motor that rotates frame that supports film roll holding units)
160 Splicing Device
162 Heater
166 Knife (Cutting Member)
168 Pinch Roller
200 Bag-making and Packaging Unit
300 Control Unit
408A Photoelectric Sensor (sensor that detects posture of frame that supports film roll holding units)
408B Photoelectric Sensor (sensor that detects posture of frame that supports film roll holding units)
1000 Bag-making and Packaging Apparatus
F Film
FR Film Rolls

What is claimed is:

1. A bag-making and packaging apparatus comprising:

a bag-making and packaging unit adapted to form a sheet of film into a tubular shape and to seal the film that has been formed into the tubular shape to thereby form the film into bags;

a film feeding unit that has a plurality of film roll holding units, each of which is adapted to hold thereon a supply roll of film and to feed to the bag-making and packaging unit film that is drawn from the supply roll of film held thereon;

a splicing device adapted to automatically splice together 1) a tail end of film being drawn from the supply roll of film held on a first, active one of the plurality of film roll holding units and being fed to the bag-making and packaging unit from the film feeding unit and 2) a leading end of film to be drawn from the supply roll of film held on a second, standby one of the plurality of film roll holding units and to be fed to the bag-making and packaging unit from the film feeding unit; and a control unit adapted to control operation of the bag-making and packaging apparatus in an auto-feeding mode, during which auto-feeding mode the leading end of film to be drawn from the supply roll of film held on the second, standby one of the plurality of film roll holding units is automatically spliced to the tail end of film being drawn from the supply roll of film held on the first, active one of the plurality of film roll holding units to so as to replenish automatically film that is fed to the bag-making and packaging unit when the supply roll of film held on the first, active one of the plurality of film roll holding units is exhausted, wherein the control unit is configured such that when the control unit judges that the splicing device is malfunctioning and/or that the film feeding unit is partially malfunctioning in a way that leaves one of the plurality of film roll holding units still able to feed film to the bag-making and packaging unit in a case where the control unit is utilizing bag-making and packaging apparatus is operating in the auto-feeding mode, the control unit stops the auto-feeding mode and controls operation of the bag-making and packaging apparatus in a non-auto feeding mode that allows bag-making operations to be continued by the bag-making and packaging unit and said film roll holding unit that is still able to feed film to the bag-making and packaging unit.

2. The bag-making and packaging apparatus according to claim 1, further comprising an operating mode switching unit that at least receives an operation for switching the operating mode from an operator.

3. The bag-making and packaging apparatus according to claim 2, wherein when the control unit judges that the splicing device is malfunctioning and/or that the film feeding unit is partially malfunctioning in a way that leaves one of the plurality of film roll holding units still able to feed film to the bag-making and packaging unit in a case where the bag-making and packaging apparatus is operating in the auto-feeding mode, the control unit stops the auto-feeding mode and stops operation of the bag-making and packaging unit to enable the operator to switch operation of the bag-making and packaging apparatus to the non-auto feeding mode.

4. The bag-making and packaging apparatus according to claim 3, wherein when the control unit stops the operation of the bag-making and packaging unit, the control unit switches to the non-auto feeding mode in a case where an operating mode switching unit that at least receives an operation for switching the operating mode from the operator has received an operation to switch to the non-auto feeding mode.

5. The bag-making and packaging apparatus according to claim 3, wherein when the control unit has stopped the operation of the bag-making and packaging unit, the control unit resumes the operation of the bag-making and packaging unit once the path of the film fed to the bag-making and packaging unit has been changed from a first path, which utilizes the splicing device to a second path that is different from the first path.

6. The bag-making and packaging apparatus according to claim 1, wherein the film feeding unit includes at least motors that cause the supply rolls of film held on the film roll holding units to rotate, a motor that rotates a frame that supports the film roll holding units, and a sensor that detect the posture of the frame that supports the film roll holding units, and the splicing device includes at least one of a heater for applying heat to and thermocompressively bonding said leading end of film and said tail end of film, a cutting member for cutting the film, and a pinch roller for conveying the film.

* * * * *